US012672699B2

(12) United States Patent
Orand et al.

(10) Patent No.: US 12,672,699 B2
(45) Date of Patent: Jul. 7, 2026

(54) ADJUSTMENT SYSTEM FOR ARTICLE OF FOOTWEAR

(71) Applicant: NIKE, Inc., Beaverton, OR (US)

(72) Inventors: Austin J. Orand, Portland, OR (US); Yen-Lin Lee, Taichung City (TW); To-Chun Lin, Taichung City (TW); Chih-Ta Chien, Meishan Township, Chiayi County (TW); Richard Kristian Hansen, Vancouver, WA (US); Chia-Chi Lin, Zhuqi Township, Chiayi County (TW); Kimberly A. Sokol, Vancouver, WA (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/982,704

(22) Filed: Dec. 16, 2024

(65) Prior Publication Data

US 2025/0194750 A1 Jun. 19, 2025

Related U.S. Application Data

(60) Provisional application No. 63/612,297, filed on Dec. 19, 2023.

(51) Int. Cl.
*A43B 23/02* (2006.01)

(52) U.S. Cl.
CPC ..... *A43B 23/0285* (2013.01)

(58) Field of Classification Search
CPC ... A43B 23/029; A43B 23/0285; A43B 11/00; A43C 11/00
See application file for complete search history.

(56) References Cited

U.S. PATENT DOCUMENTS

| | | | | |
|---|---|---|---|---|
| 5,617,650 | A * | 4/1997 | Grim | A43B 7/147 36/154 |
| 5,669,161 | A * | 9/1997 | Huang | A43B 23/26 36/43 |
| 6,305,102 | B1 * | 10/2001 | Doyle | A43B 13/206 36/71 |
| 2002/0026662 | A1 * | 3/2002 | Huang | A43B 13/203 2/455 |
| 2018/0110286 | A1 | 4/2018 | Vuong | |
| 2019/0000186 | A1 | 1/2019 | Mou et al. | |
| 2021/0127788 | A1 | 5/2021 | Li | |

OTHER PUBLICATIONS

European Patent Office (ISA), International Search Report and Written Opinion for PCT App. No. PCT/US2024/060582, mailed Mar. 11, 2025.

* cited by examiner

*Primary Examiner* — Ted Kavanaugh
(74) *Attorney, Agent, or Firm* — Honigman LLP; Matthew H. Szalach

(57) ABSTRACT

An adjustment system for an article of footwear includes a body attached to an outer surface of the article of footwear and including a plurality of segments cooperating to define a chamber, the body movable between an elongated state and a collapsed state and a bladder attached to the article of footwear and defining an interior void in fluid communication with the chamber, the bladder movable from a relaxed state to a constricted state when the body is moved from the collapsed state to the elongated state.

20 Claims, 23 Drawing Sheets

ADJUSTMENT SYSTEM FOR ARTICLE OF FOOTWEAR

CROSS REFERENCE TO RELATED APPLICATIONS

This application claims priority under 35 U.S.C. § 119(e) to U.S. Provisional Application No. 63/612,297, filed on Dec. 19, 2023. The disclosure of this prior application is considered part of the disclosure of this application and is hereby incorporated by reference in its entirety.

FIELD

The present disclosure relates generally to an adjustment system for an article of footwear.

BACKGROUND

This section provides background information related to the present disclosure and is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

While conventional uppers include structures such as laces, straps, and fasteners to secure an upper around a foot of a wearer, such conventional structures—while adequately securing the upper and, thus, the article of footwear, to a wearer's foot-do not generally conform the upper to the wearer's foot. Accordingly, a wearer's foot may be permitted to move relative to and within the upper of the article of footwear. Such relative movement between the foot and the upper results in relative movement between the foot and the sole structure. Accordingly, energy may be lost in running, jumping, banking, and other athletic movements due to the relative movement between the wearer's foot and the upper of the article of footwear, thereby resulting in inefficiencies during use.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1A:
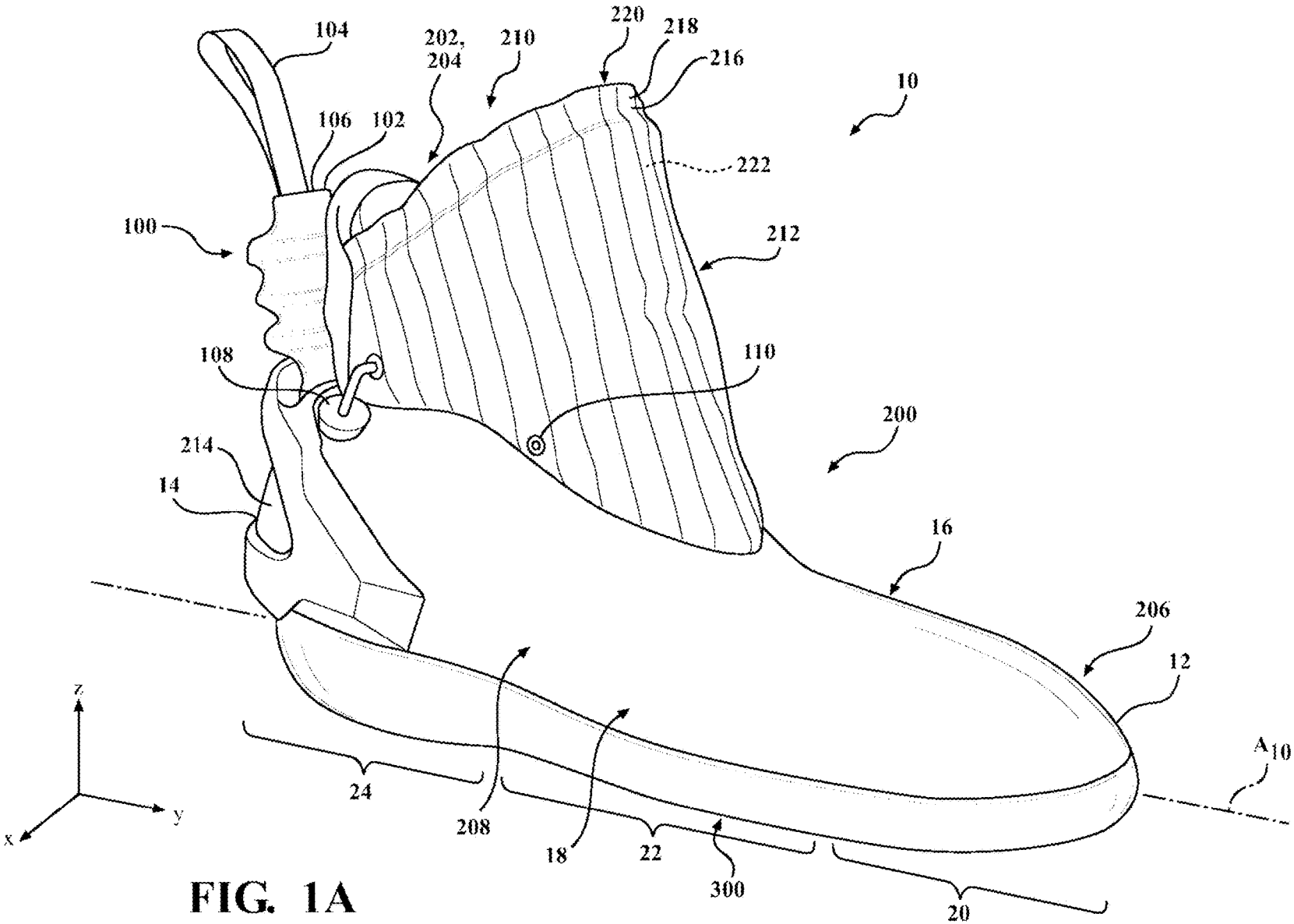
FIG. 1A is a perspective view of an example of an article of footwear with an adjustment system and a flex region in a relaxed state according to the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, an adjustment system for an article of footwear includes a body attached to an outer surface of the article of footwear and including a plurality of segments cooperating to define a chamber, the body movable between an elongated state and a collapsed state and a bladder attached to the article of footwear and defining an interior void in fluid communication with the chamber, the bladder movable from a relaxed state to a constricted state when the body is moved from the collapsed state to the elongated state.

The adjustment system may include one or more of the following optional features. For example, the plurality of segments may nest with one another when the body is in the collapsed state. Additionally or alternatively, the plurality of segments may provide the body with an accordion shape. The body may include a plurality of fold lines separating adjacent segments, the plurality of fold lines causing the plurality of segments to be folded on top of one another when the body is moved from the elongated state to the collapsed state.

In one configuration, a volume of fluid may be removed from the interior void of the bladder when the bladder is moved from the relaxed state to the constricted state. The volume of fluid may be moved from the interior void and into the chamber of the body when the body is moved from the collapsed state to the elongated state.

The body may be biased into the collapsed state. An elastic member may surround at least a portion of the body and may be configured to bias the body into the collapsed state. Additionally or alternatively, segments of the plurality of segments may each include a series of substantially planar surfaces defining a shape of each segment, the substantially planar surfaces may be substantially parallel to one another when the body is in the collapsed state.

An article of footwear may incorporate the adjustment system.

In another configuration, an article of footwear includes an upper, a body attached to the upper and including a plurality of substantially planar surfaces cooperating to define a chamber, the body movable between an elongated state and a collapsed state, and a bladder attached to the upper and defining an interior void in fluid communication with the chamber, the bladder movable from a relaxed state to a constricted state when the body is moved from the collapsed state to the elongated state.

The adjustment system may include one or more of the following optional features. For example, the plurality of substantially planar surfaces may cooperate to provide the body with a plurality of segments each containing at least two substantially planar surfaces of the plurality of substantially planar surfaces. The plurality of segments may nest with one another when the body is in the collapsed state. Additionally or alternatively, the plurality of substantially planar surfaces may provide the body with an accordion shape.

In one configuration, the body may include a plurality of fold lines separating adjacent substantially planar surfaces, the plurality of fold lines causing the plurality of substantially planar surfaces to be folded on top of one another when the body is moved from the elongated state to the collapsed state. Additionally or alternatively, a volume of fluid may be removed from the interior void of the bladder when the bladder is moved from the relaxed state to the constricted state. The volume of fluid may be moved from the interior void and into the chamber of the body when the body is moved from the collapsed state to the elongated state.

The body may be biased into the collapsed state. An elastic member may surround at least a portion of the body and may be configured to bias the body into the collapsed state. Additionally or alternatively, the plurality of substantially planar surfaces may be stacked on one another when the body is moved from the elongated state to the collapsed state.

The details of one or more implementations of the disclosure are set forth in the accompanying drawings and the description below. Other aspects, features, and advantages will be apparent from the description, the drawings, and the claims.

With reference to FIGS. 1A-4, an article of footwear 10 includes an adjustment system 100 attached to an upper 200. The article of footwear 10 also includes a sole structure 300 attached to the upper 200 to provide support along a ground contacting surface of the footwear 10. The article of footwear 10 further includes an anterior end 12 associated with a forward-most point of the footwear 10 and a posterior end 14 corresponding to a rearward-most point of the footwear 10. A longitudinal axis $A_{10}$ of the footwear 10 extends along a length of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18. The lateral direction may also refer to a direction extending from the ground surface to a topmost portion of the upper 200.

The article of footwear 10 may be divided into one or more regions. The regions may include a forefoot region 20, a mid-foot region 22, and a heel region 24. The forefoot region 20 is associated with phalanges and metatarsal bones of a foot. The mid-foot region 22 may correspond with an arch area of the foot, and the heel region 24 may correspond with rear portions of the foot, including a calcaneus bone.

Referring still to FIGS. 1A-4, the upper 200 includes interior surfaces that define an interior space 202 and an ankle opening 204 configured to receive and secure a foot for support on the sole structure 300. The upper 200, and components thereof, may be described as including various subcomponents or regions. For example, the upper 200 includes a toe cap 206 disposed at the anterior end 12 and extending over the toes from the medial side 16 to the lateral side 18. A pair of quarter panels 208 extend from the toe cap 206 in the mid-foot region 22 on opposite sides of the interior space 202. A throat 210 extends across the top of the upper 200 and includes an instep region extending between the quarter panels 208 from the toe cap 206 to the ankle opening 204. In the illustrated example, the throat 210 at least partially includes a flex region 212, described in more detail below, whereby the flex region 212 may expand and contract about the ankle for retaining the foot within the footwear 10. The flex region 212 extends between the opposing quarter panels 208 in the instep region to cover the interior space 202. The flex region 212 may be formed from a material having a higher modulus of elasticity than the material forming the quarter panels 208 to facilitate movement of the flex region 212 between an expanded state and a contracted state.

Figure 1B:
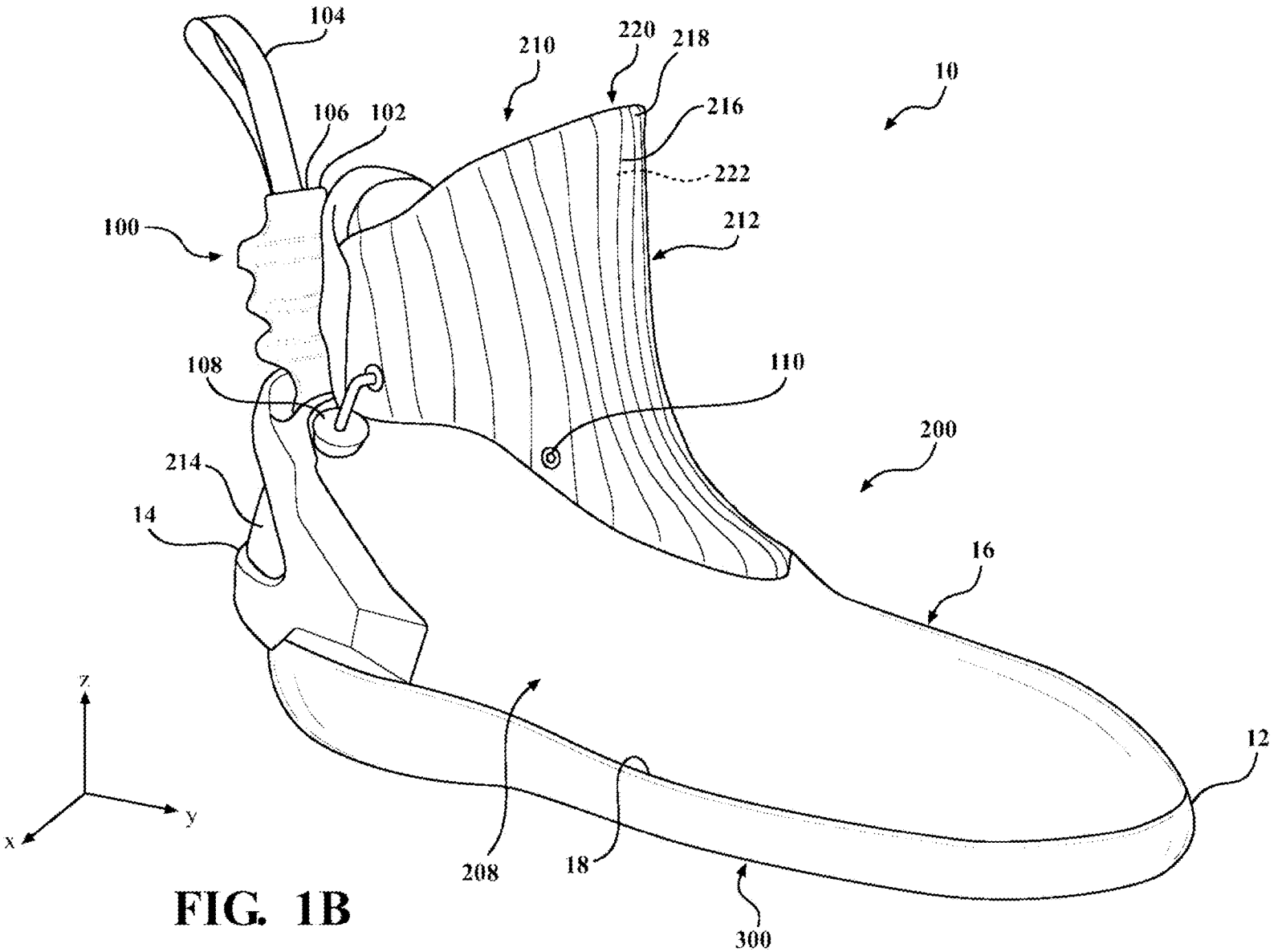
FIG. 1B is a perspective view of the article of footwear of FIG. 1A with the flex region in a contracted state according to the present disclosure.
Figure 2:
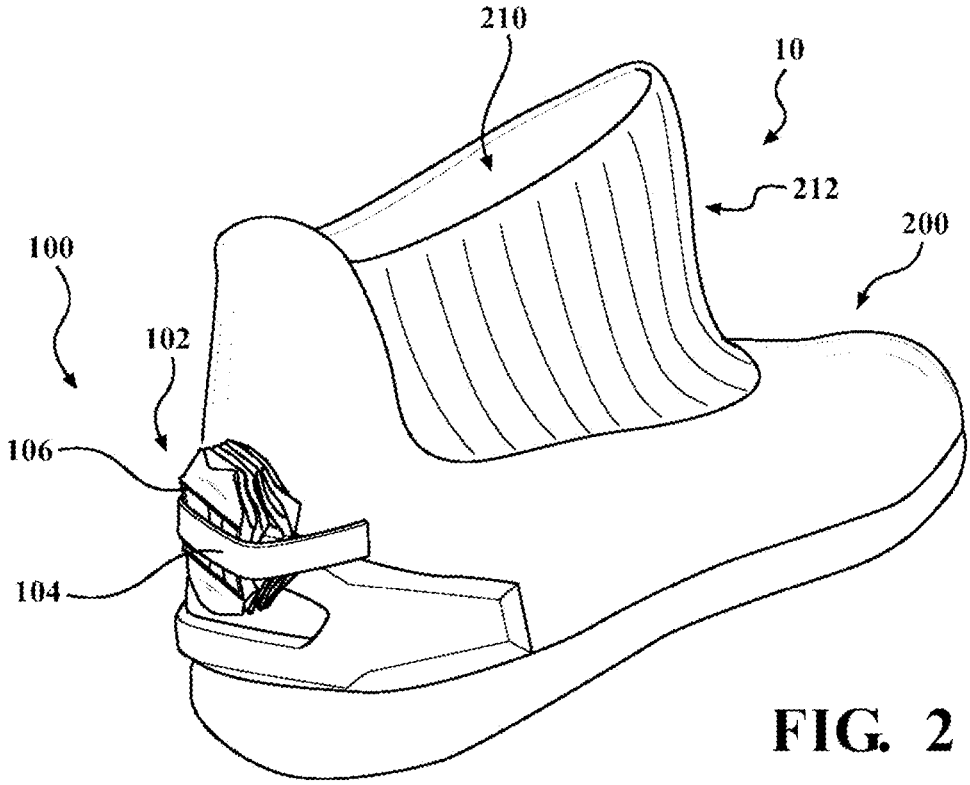
FIG. 2 is a rear perspective view of an article of footwear with an adjustment system in a compressed state according to the present disclosure.

The upper 200 of the article of footwear 10 may be further described as including heel side panels 214 extending through the heel region 24 along the medial and lateral sides 16, 18 of the upper 200. As illustrated in FIGS. 1A and 1, the adjustment system 100 may be positioned at the posterior end 14 of the footwear 10 and may be attached at the heel side panels 214 of the upper 200 to define fluid communication between the adjustment system 100 and the flex region 212 of the upper 200.

Suitable materials of the upper 200 may include, but are not limited to, mesh textiles, foam, leather, and synthetic leather. The materials may be selected and located to impart properties of durability, air-permeability, wear-resistance, flexibility, and comfort. The example upper 200 may include an inner liner including a combination of one or more substantially inelastic or non-stretchable materials and/or one or more substantially elastic or stretchable materials disposed in different regions of the upper 200 to facilitate movement of the article of footwear 10 between a tightened state and a loosened state. The one or more elastic materials may include any combination of one or more elastic fabrics such as, without limitation, spandex, elastane, rubber, or neoprene. The one or more inelastic materials may include any combination of one or more thermoplastic polyurethanes, nylon, leather, vinyl, or another material/fabric that does not impart properties of elasticity. The flex region 212 further facilitates the article of footwear 10 moving between the tightened state and the loosened state by contraction and release at the throat 210 of the upper 200. While the flex region 212 is depicted as defining the throat 210 of the upper 200, it is contemplated that any portion of the upper 200 may be configured with the flex region 212. For example, the entirety of the upper 200 may be constructed from the flex region 212.

Referring further to FIGS. 1A and **1*i*, the flex region 212 is configured as a moveable bladder 216 including a first film or barrier layer 218 and a second film or barrier layer 218. The first barrier layer 218 and the second barrier layer 218 cooperate to define an interior void 220 of the bladder 216 that is in fluid communication with the adjustment system 100, as described in more detail below. The bladder 216 of the flex region 212 may be formed by joining the first barrier layer 218 and the second barrier layer 218 using a radio frequency (RF) welding process. However, it is also contemplated that the bladder 216 may be formed via a thermoforming or blow-molding process, such that the bladder 216** may be free from peripheral seams.

The bladder 216 may include a fill structure configured to provide structural support for the first and second barrier layers 218 during transition of the flex region 212 from a relaxed state to a constricted state. For example, the fill structure may facilitate maintaining the structural integrity of the flex region 212 for increased stability at the throat 210 around an ankle. Additionally or alternatively, the flex region 212 may be free of a fill structure, such that the first barrier layer 218 and the second barrier layer 218 have geometric configurations that facilitate the structural integrity of the flex region 212 under vacuum. The fill material may further provide structural support when the flex region 212 is constricted to minimize collapse of the flex region 212. While the flex region 212 is configured to constrict toward the foot, the flex region 212 also provides structural support for the foot during use.

As used herein, the term "barrier layer" (e.g., barrier layers 218) encompasses both monolayer and multilayer films. In some embodiments, one or both of barrier layers 218 are each produced (e.g., RF welded, thermoformed or blow molded) from a monolayer film (a single layer). In other embodiments, one or both of the barrier layers 218 are each produced (e.g., RF welded, thermoformed or blow molded) from a multilayer film (multiple sublayers). In either aspect, each layer or sublayer can have a film thickness ranging from approximately 0.2 micrometers to approximately 1 millimeter. In further embodiments, the film thickness for each layer or sublayer can range from approximately 0.5 micrometers to approximately 500 micrometers. In yet further embodiments, the film thickness for each layer or sublayer can range from approximately 1 micrometer to approximately 100 micrometers. In one configuration, the barrier layers 218 have a thickness of approximately 0.5 millimeters to approximately 0.7 millimeters. In another configuration, the barrier layers 218 have a thickness of approximately 0.64 millimeters to approximately 0.76 millimeters.

One or both of the barrier layers 218 can independently be transparent, translucent, and/or opaque. As used herein, the term "transparent" for a barrier layer means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 218 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, nylon, and other polymeric materials known to have relatively low gas transmission rates. Blends of these materials as well as with the TPU copolymers described herein and optionally including combinations of polyamides and crystalline polymers, are also suitable.

The barrier layers 218 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 218 include two or more sublayers, examples of suitable multilayer films include microlayer films, such as those disclosed in Bonk et al., U.S. Pat. No. 6,582,786, which is incorporated by reference in its entirety. In further embodiments, barrier layers 218 may each independently include alternating sublayers of one or more TPU copolymer materials and one or more EVOH copolymer materials, where the total number of sublayers in each of the barrier layers 218 includes at least four (4) sublayers, at least ten (10) sublayers, at least twenty (20) sublayers, at least forty (40) sublayers, and/or at least sixty (60) sublayers.

The bladder 216 can be produced from the barrier layers 218 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 218 can be produced by co-extrusion followed by vacuum thermoforming to produce the bladder 216.

In some embodiments, the bladder 216 has a gas transmission rate for nitrogen gas that is at least approximately ten (10) times lower than a nitrogen gas transmission rate for a butyl rubber layer of substantially the same dimensions. In an aspect, bladder 216 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of the barrier layers 218). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

In the illustrated example, the flex region 212 includes a plurality of compression lines 222, which are drawn together when a vacuum is drawn within the interior void 220 of the flex region 212. The flex region 212 is operable between the relaxed state and the constricted state and contracts along a z-axis (Z) under vacuum (FIG. 1). The degree of constriction along the z-axis (Z) may be variable and dependent upon the vacuum drawn by the adjustment system 100. For example, the flex region 212 may be partially constricted to provide a customized fit for a particular wearer. The customized fit may depend on the wearer and/or additional articles used in combination with the article of footwear 10. For example, the customization of the flex region 212 may facilitate accommodating articles including, but not limited to, socks of varying thickness, athletic wraps, ankle braces, and/or any other article that may be positioned between the flex region 212 and an ankle or foot of the wearer. The first and second barrier layers 218 are drawn together when the vacuum is applied to the flex region 212, thereby decreasing an internal volume of the bladder 216, such that the flex region 212 has increased rigidity in the constricted state. Stated differently, the adjustment system 100 draws fluid from the interior void 220 of the bladder 216 into a collapsible body 102 of the adjustment system 100 to constrict the flex region 212 around an ankle and foot.

Figure 3:
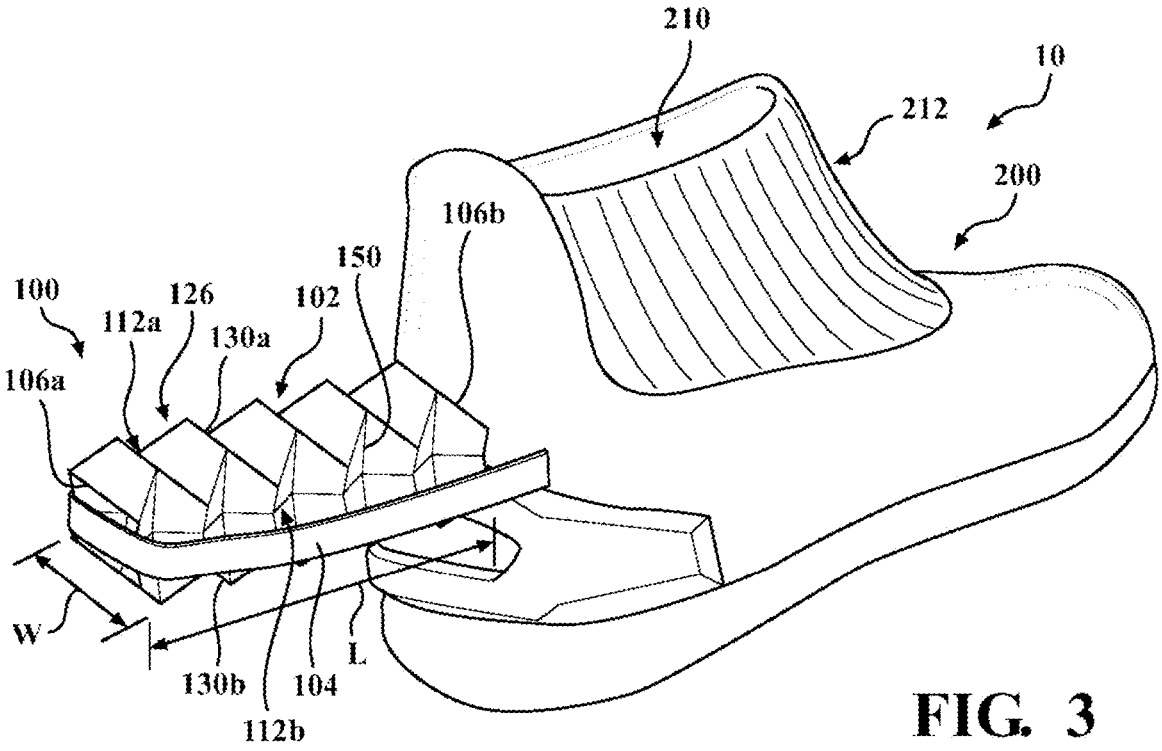
FIG. 3 is a rear perspective view of the article of footwear of FIG. 2 with the adjustment system in an extended state according to the present disclosure.
Figure 4:
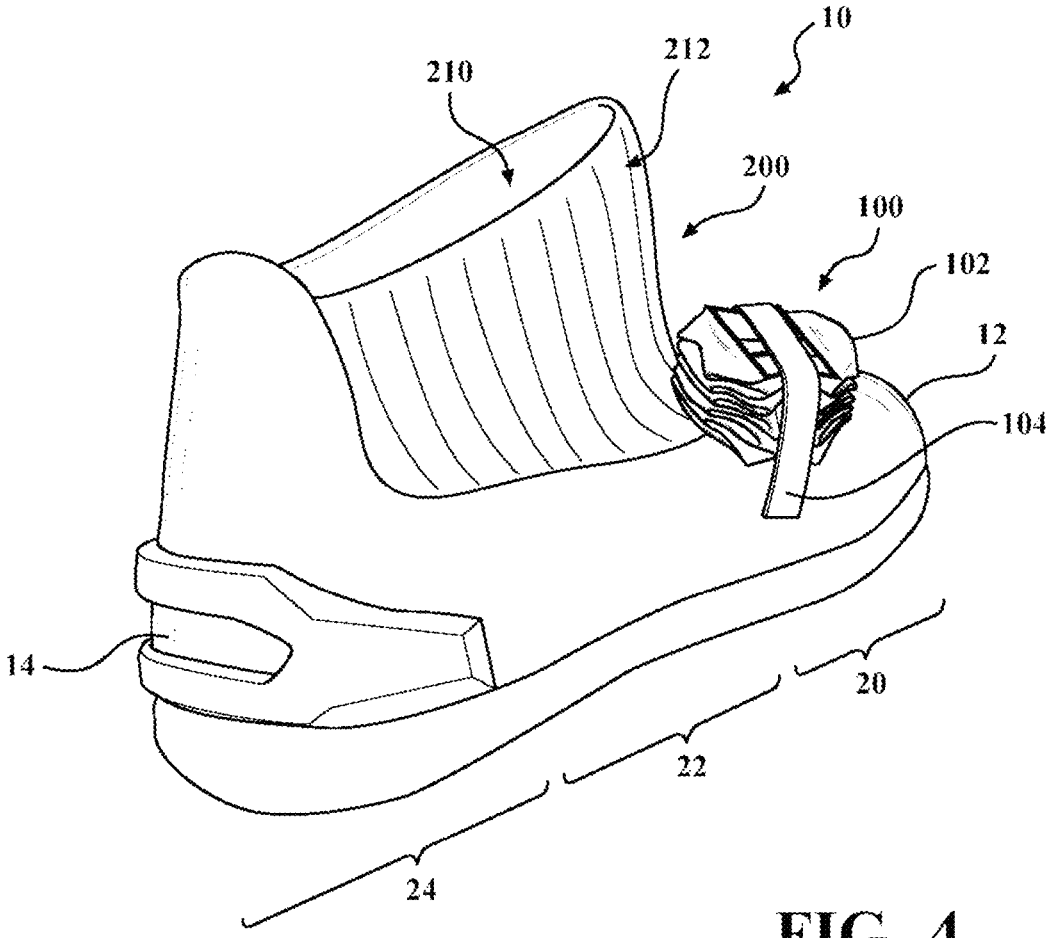
FIG. 4 is a rear perspective view of an article of footwear with an adjustment system according to the present disclosure.

With reference now to FIGS. 3-7, the adjustment system 100 may be positioned along the footwear 10 in any practical location in fluid communication with the upper 200. FIG. 3 illustrates the adjustment system 100 at the posterior end 14 of the footwear 10 attached to the heel side panels 214 of the upper 200. In some aspects, the adjustment system 100 may be attached to the toe cap 206 of the upper 200, as depicted in FIG. 4. The adjustment system 100 is configured to translate the flex region 212 between the relaxed state and the constricted state via a wearer's engagement with the adjustment system 100. As mentioned above, the adjustment system 100 includes the collapsible body 102, which is operable between a compressed state and an extended state and is attached to the upper 200. The adjustment system 100 also includes an elastomeric member 104 attached to the collapsible body 102 and the upper 200.

Figure 9:
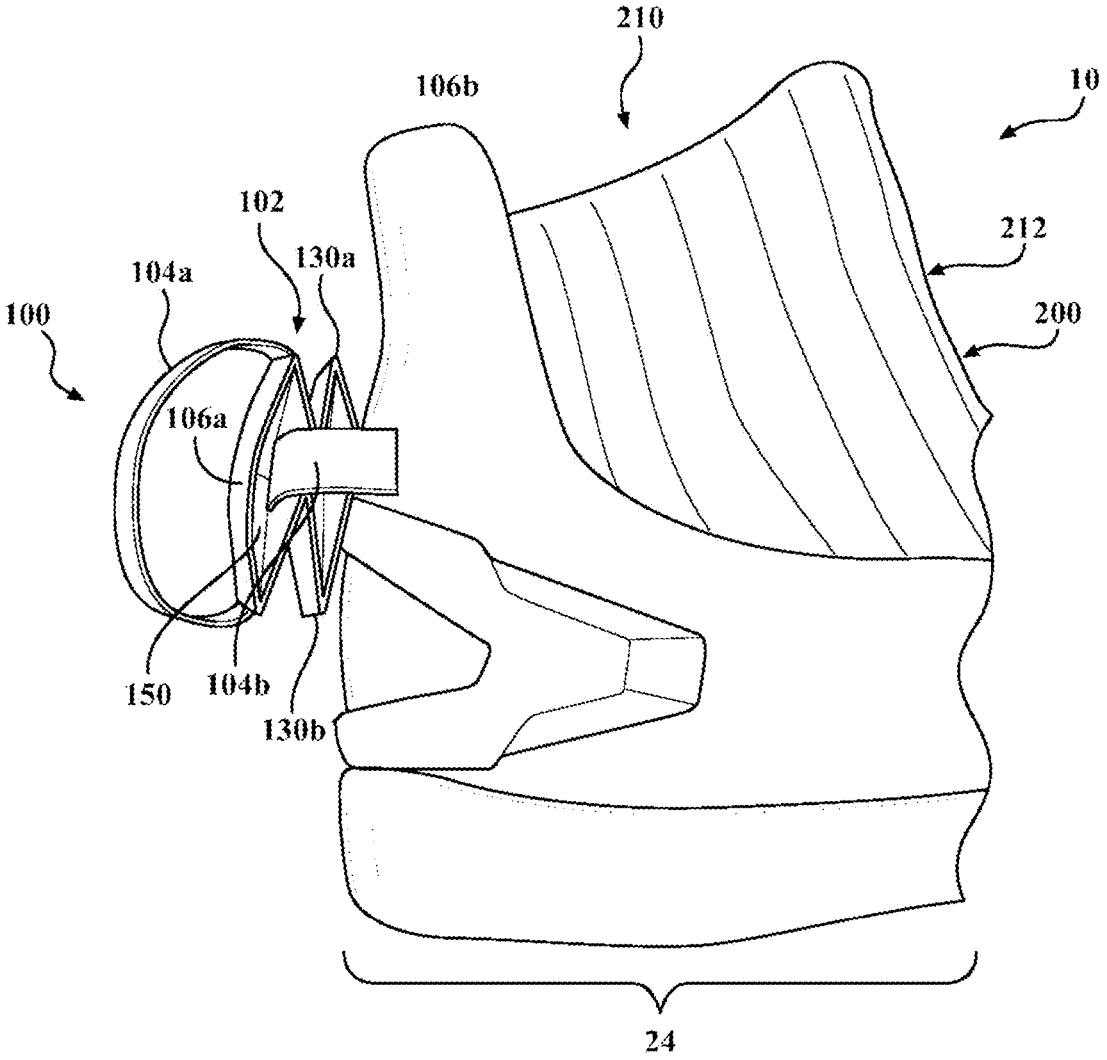
FIG. 9 is a partial side view of an article of footwear incorporating an adjustment system according to the present disclosure.

The collapsible body 102 translates between the compressed state and the extended state via actuation of the elastomeric member 104, which may at least partially retain the collapsible body 102 against the upper 200 in the compressed state. The elastomeric member 104 may extend over a first end 106*a* of the collapsible body 102 with a second end 106*b* of the elastomeric member 104 being attached to and in fluid communication with the upper 200. In some configurations, the elastomeric member 104 may include an actuation element 104*a* extending from the first end 106 of the collapsible body 102 and retention elements 104*b* extending between the first end 106*a* of the collapsible body 102 and the upper 200 and disposed along a length L of the collapsible body 102. For example, the retention elements 104*b* are illustrated in FIG. 9 as attaching the collapsible body 102 to the upper 200 and retaining the collapsible body 102 in the compressed state. Comparatively, the actuation element 104*a* may be utilized to move the collapsible body 102 into the extended state and draw a vacuum within the interior void 220 of the flex region 212.

Referring still to FIGS. 3-7, the elastomeric member 104 may be an elastic strap with a high degree of tension to retain the collapsible body 102 in the compressed state and to define a low-profile of the adjustment system 100. The retention elements 104*b* may have a greater degree of tension as compared to the actuation element 104*a* to facilitate the vacuum draw by the collapsible body 102 as the wearer extends the collapsible body 102 from the compressed state to the extended state via the actuation element 104*a*. In some aspects, the elastomeric member 104 may extend along a central region of the collapsible body 102 for equal distribution of pull and compressive pressure on the collapsible body 102. In other examples, the elastomeric member 104 may have a thickness approximately equal to a thickness of the collapsible body 102. The thickness of the elastomeric member 104 may depend upon the elastomeric properties of the elastomeric member 104, such that a greater thickness of the elastomeric member 104 may result in increased rigidity of the elastomeric member 104. The degree of rigidity may be considered in calibrating the adjustment system 100 to control the rate of vacuum draw, whereby a higher rigidity of the elastomeric member 104 may facilitate a slower and more efficient vacuum draw of the flex region 212 by the collapsible body 102.

Figure 10:
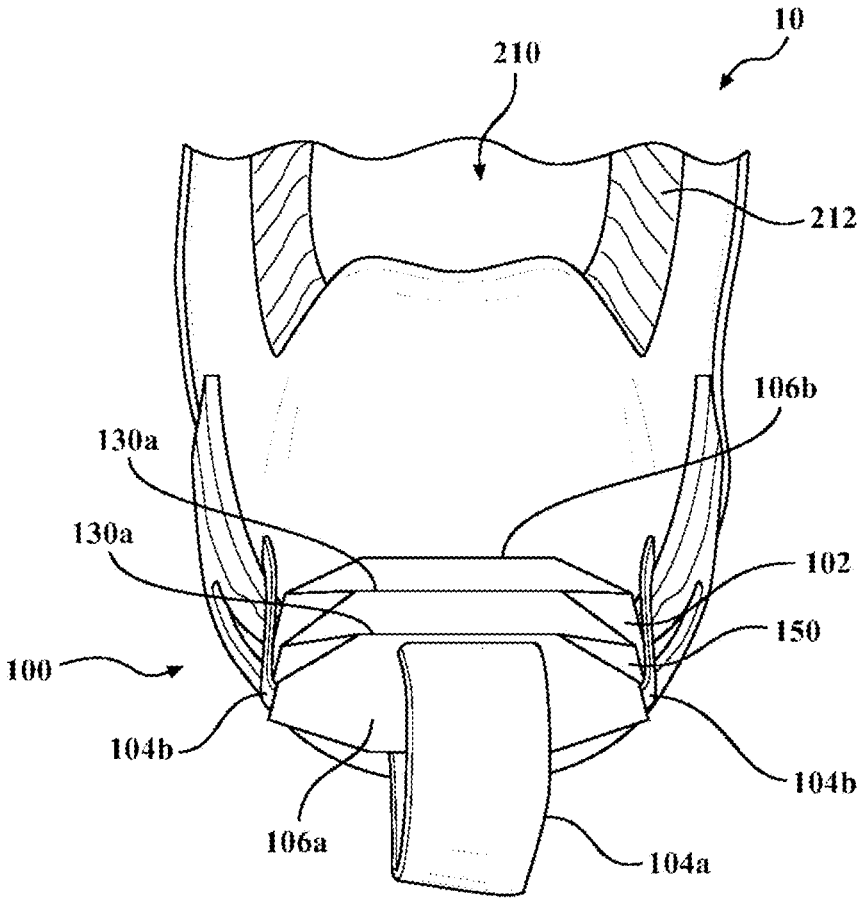
FIG. 10 is an enlarged partial top plan view of the adjustment system of FIG. 9.
Figure 11:
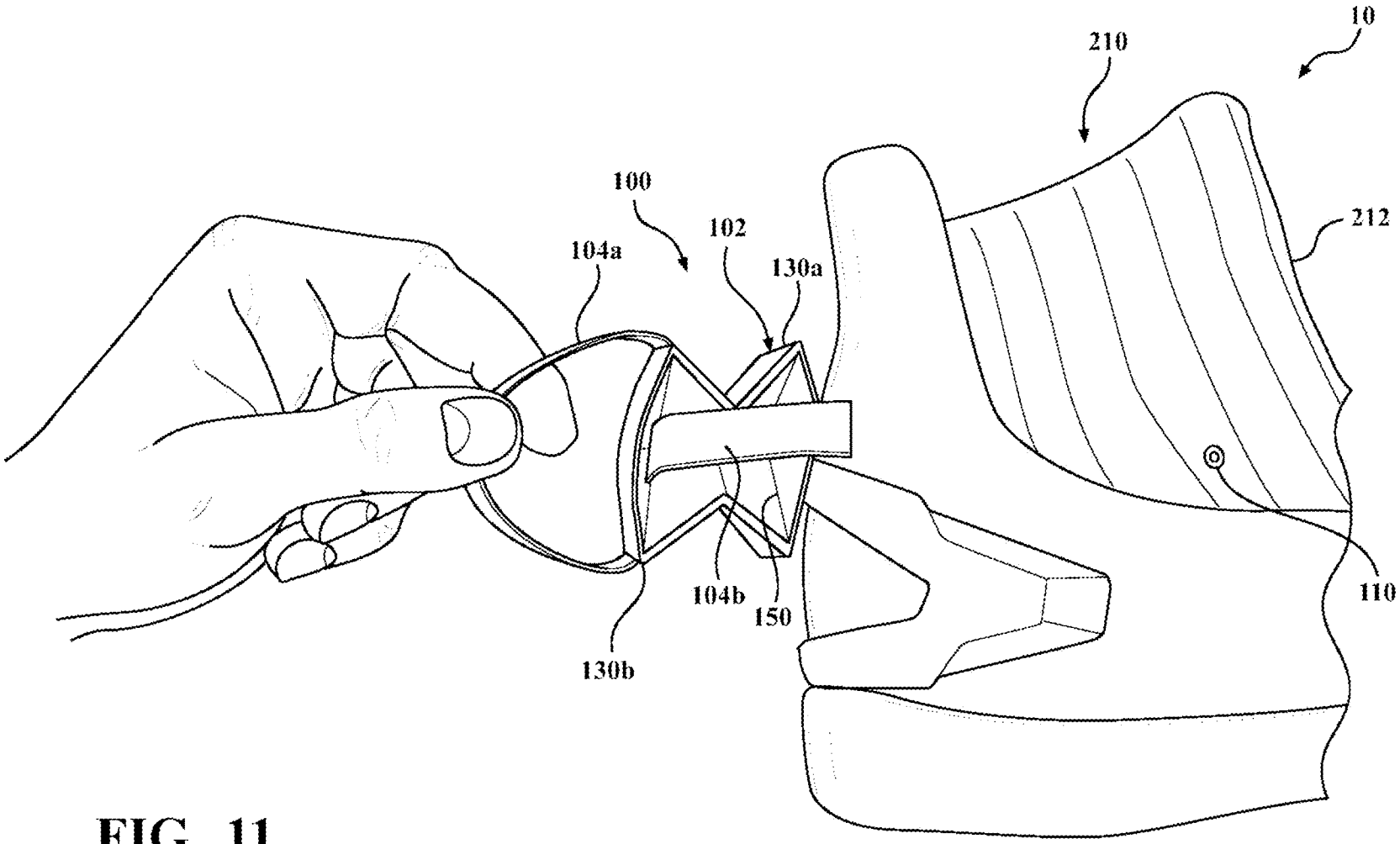
FIG. 11 is an enlarged partial side elevation view of the adjustment system of FIG. 9 in a partially extended state.

The adjustment system 100 also includes a first, draw valve 108*a* that provides fluid communication between the flex region 212 of the upper 200 and the collapsible body 102 and a second, expulsion valve 108*b* that provides fluid communication between the collapsible body 102 and the surrounding ambient environment. As depicted in FIG. 1A, the first valve 108*a* is positioned on one of the heel side panels 214 proximate the flex region 212 on the lateral side 18 of the footwear 10. However, the first valve 108*a* may be positioned in any practicable location along the upper 200 to provide fluid communication between the adjustment system 100 and the flex region 212 of the upper 200. For example, the first valve 108*a* and the second valve 108*b* can be incorporated with the collapsible body 102 at the second end 106*b* of the collapsible body 102. In some configurations, the valves 108*a*, 108*b* are check valves that facilitate one-way fluid communication from the flex region 212 to the collapsible body 102 and from the collapsible body 102 into the surrounding environment. The adjustment system 100 may also include a spring-loaded release valve 110 configured to draw air into the flex region 212 and transition the flex region 212 from the compressed state to the expanded state, as described in more detail below. Thus, the valves 108*a*, 108*b* facilitate the vacuum draw of the flex region 212, while the release valve 110 returns the flex region to the relaxed state, the process of which is described herein with respect to FIGS. 9-11.

With continued reference to FIGS. 3-7, the collapsible body 102 is formed from a single sheet of material that is manipulated into a plurality of complex folds 120 using various origami techniques. A complex fold is defined as a fold that flattens to form more than one crease or utilizes more than one crease in a folding sequence. As described below, the complex folds 120 may include a compression fold 122 and creases 124 in defining the collapsible body 102. The material used for the collapsible body 102 may include, but is not limited to, TPU or polyurethane (PU) film layers having a thickness ranging from approximately 0.2 millimeters to approximately 2.0 millimeters. The TPU material may have a hardness ranging from 45 Shore A to 95 Shore A and, more particularly, from 45 Shore A to 65 Shore A. In one configuration, the hardness of the TPU material is 65 Shore A. The collapsible body 102 may be extruded and laminated with hotmelt adhesive to facilitate bonding of the material. In the structured state, the material used for the collapsible body 102 may have a thickness in the range of approximately 0.6 millimeters to approximately 2.0 millimeters. However, the range of thicknesses may be less than 0.6 millimeters or greater than 2.0 millimeters. During the formation process, the complex folds 120 are defined along the material to ultimately result in the three-dimensional configuration of the collapsible body 102 shown in FIG. 5A.

While the collapsible body 102 is defined by the complex folds 120, it is contemplated that edges of the material may be joined together via a high-frequency weld to form the three-dimensional structure of the collapsible body 102. Other methods are contemplated to define the three-dimensional structure including, but not limited to, injection molding, blow molding, cement or thermal forming, and any other practicable formation process. The collapsible feature of the collapsible body 102 is defined as a result of the various folds 120, 122 and creases 124 defined along the material that cooperate to provide an expandable and collapsible structure for the collapsible body 102.

The complex folds 120 are defined along the length L and a width W of the material and may include various folding geometries that cooperate to define the compression fold 122 of the collapsible body 102. The compression fold 122 is defined as a complex fold 120 in which a grid of previously established intersecting creases 124 are used simultaneously to collapse respective segments 126 of the collapsible body 102. Stated differently, the compression fold 122 is an amalgamation of the complex folds 120 that ultimately facilitate the collapse and low-profile of the collapsible body 102 in the compressed state. The collapsible body 102 may be segmented into the segments 126 defined by the creases 124 and the compression fold 122 defined along the material that forms the collapsible body 102. In two-dimensions, each segment 126 has a generally rectangular shape to extract a greater volume of air from the bladder 216 during use and for the entirety of the collapsible body 102 to retract into a flat, low-profile state when compressed. For example, the collapsible body 102 is illustrated in FIG. 5A as having a first length $L_1$ in the compressed state that is less than a second length $L_2$ of the collapsible body 102 in the extended state.

In addition to the expansion and contraction between the extended and compressed states, the shape of each respective segment 126 further facilitates the minimized length $L_2$ of the collapsible body 102 to conform to the footwear 10. The segments 126 may be in a continuous, linear arrangement along the length L of the collapsible body 102. In some aspects, the creases 124 may be configured in a manner so as to define a nesting configuration of the segments 126 by recessing an edge of the segment 126 inward to define a cavity that receives an adjacent segment 126. A nesting configuration of the segments 126 may further facilitate the low-profile and conformity of the collapsible body 102 with the footwear 10 to minimize the adjustment system 100 as a whole.

It is generally contemplated that the collapsible body 102, as a result of the origami techniques, may have a three-dimensional geometry, such that segments 126 of the plurality of segments 126 cooperate to define a three-dimensional modular assembly from identical segments or modules. Further, in some configurations, the segments 126 may decrease in size along the length L of the collapsible body 102 to facilitate nesting of the segments 126 and, thus, storage of the collapsible body 102. In so doing, the nested segments 126 provide the collapsible body 102 with a low profile in the compressed state. As described, the collapsible body 102 may be defined as having an accordion configuration operable between the compressed state and the extended state.

Figure 5A:
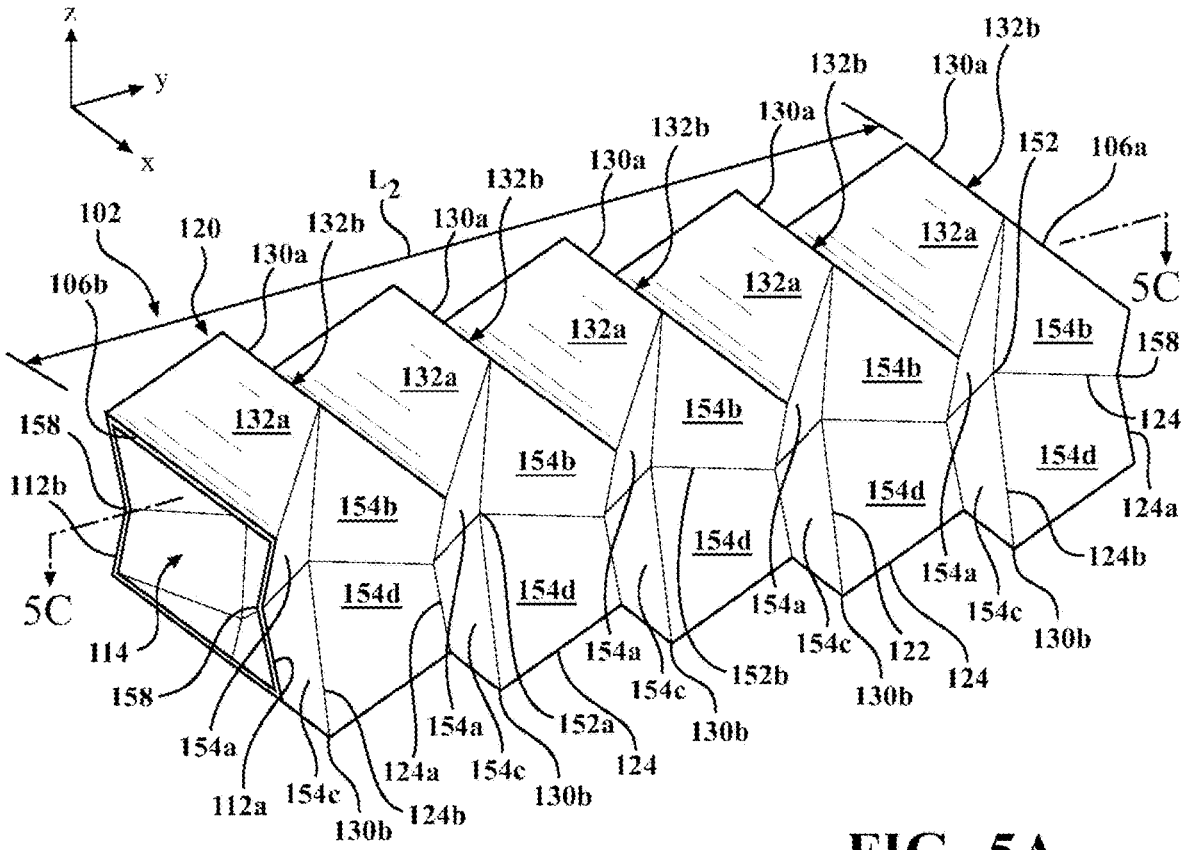
FIG. 5A is a perspective view of a collapsible body of an adjustment system in an extended state according to the present disclosure.
Figure 5B:
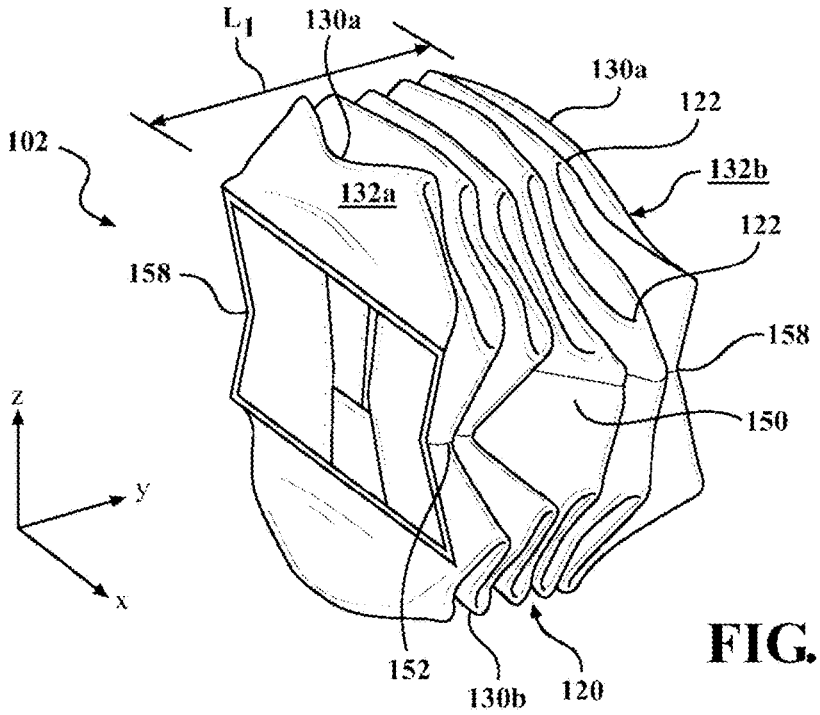
FIG. 5B is a perspective view of the collapsible body of FIG. 5A in a compressed state according to the present disclosure.
Figure 5C:
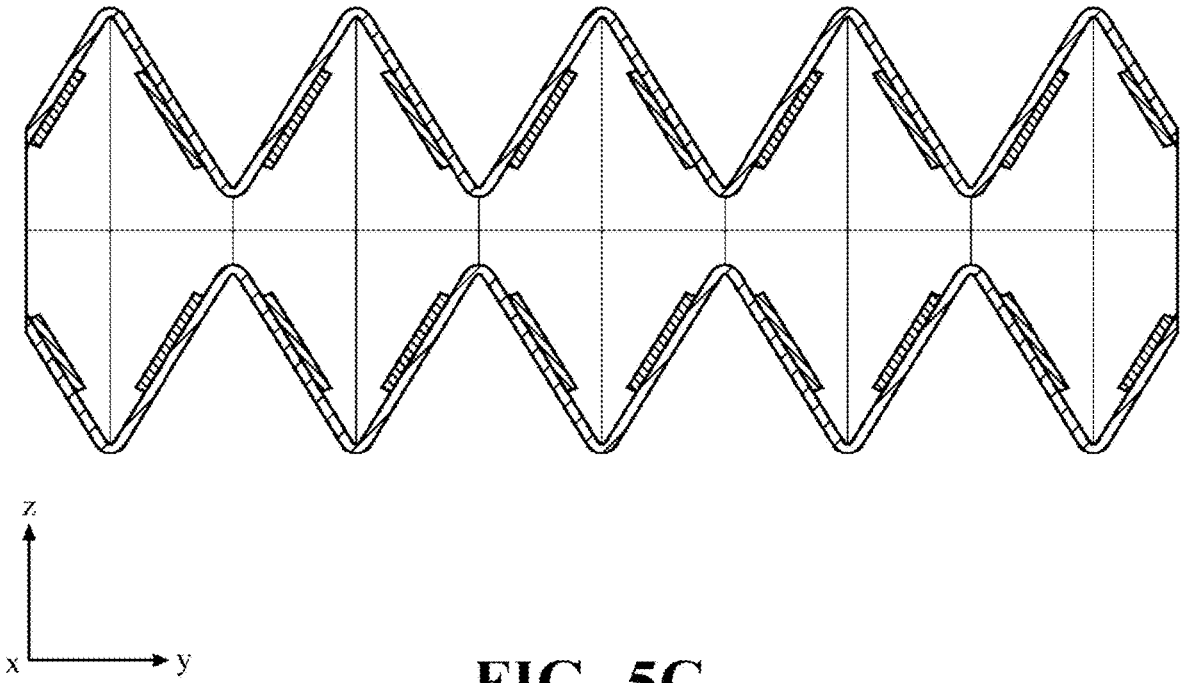
FIG. 5C is a cross-sectional view of a collapsible body of FIG. 5A, taken along Line 5C-5C of FIG. 5A.

With specific reference to FIGS. 5A and 5B, the collapsible body 102 is operable as a pump configured to draw a vacuum within the flex region 212 of the upper 200. As depicted in FIG. 5A, the plurality of segments 126 extend along the length L of the collapsible body 102 and interconnect to define the origami or accordion configuration. Each segment 126 of the collapsible body 102 includes a first hinge set 130*a* and a second hinge set 130*b* separated by recessed sidewalls 150. As mentioned above, the collapsible body 102 is formed from a single layer sheet of material with the complex folds 120 and creases 124 corresponding to the first hinge set 130*a* and the second hinge set 130*b*. For example, the first hinge set 130*a* and the second hinge set 130*b* are defined by complex folds 120 with the sidewalls 150 defined, at least in part, by the creases 124. Each of the first hinge set 130*a* and the second hinge set 130*b* are defined by opposing interface surfaces 132*a*, 132*b*. The interface surfaces 132*a*, 132*b* are proximate one another in the compressed state of the collapsible body 102, such that the hinge sets 130*a*, 130*b* are compressed to close the space between the interface surfaces 132*a*, 132*b*. As the collapsible body 102 is extended, the interface surfaces 132*a*, 132*b* are drawn apart to define an expansion angle 136 at a peak 156 of the respective hinge set 130*a*, 130*b*. It is contemplated that the expansion angle 136 may vary depending on the degree of vacuum draw, such that the wearer may partially extend the collapsible body 102 to define a small expansion angle. The expansion angle may also vary along the length L of the collapsible body 102, such that the expansion angle of the hinge sets 130*a*, 130*b* proximate to the first end 106*a* of the collapsible body 102 may be greater than the expansion angle of the hinge sets 130*a*, 130*b* proximate to the opposing second end 106*b*.

With further reference to FIGS. 5A and 5B, the recessed sidewalls 150 are each defined by the complex folds 120, which may be further defined by a longitudinal crease 152*a* and a latitudinal fold 152*b*. For example, the compression fold 122 of the complex fold 120 may be further defined by the longitudinal crease 152*a* about which each segment 126 of the collapsible body 102 compresses, as described further below.

The longitudinal creases 152*a* and the latitudinal folds 152*b* further define a first surface 154*a* and a second surface 154*b* of each recessed sidewall 150 diametrically opposing a third surface 154*c* and a fourth surface 154*d*. The longitudinal crease 152*a* extends between the first hinge set 130*a* and the second hinge set 130*b* along the y-axis (Y), and the latitudinal fold 152*b* extends between the first end 106*a* and the second end 106*b* of the collapsible body 102 along the x-axis (X). As mentioned above, a crease is a fold along which a structure (e.g., the collapsible body 102) is configured to collapse. Comparatively, a fold, while encompassing a crease, is a broader representation also encompassing structural folds that maintain a three-dimensional structure. Here, the latitudinal folds 152*b* provide structural stability of the collapsible body 102, while the longitudinal creases 152*a* are configured to collapse and compress the collapsible body 102.

Each of the first surface 154*a*, the second surface 154*b*, the third surface 154*c*, and the fourth surface 154*d* are illustrated as having a polygonal shape with each adjoining at the peak 156 of the hinge sets 130*a*, 130*b* of the respective segment 126. Stated differently, the surfaces 154*a*-154*d* converge at a center point that is defined by the intersection of the longitudinal crease 152*a* and the latitudinal fold 152*b*. The third surface 154*c* and the fourth surface 154*d* are depicted as being inversions of the first surface 154*a* and the second surface 154*b*, respectively, in that the third surface 154*c* and the fourth surface 154*d* are mirror images of the first surface 154*a* and the second surface 154*b* about the latitudinal fold 152*b*. When the collapsible body 102 is in the compressed state, the first surface 154*a* and the second surface 154*b* are in contact with one another and the third surface 154*c* and the fourth surface 154*d* are in contact with one another, such that the recessed sidewalls 150 collapse along the longitudinal creases 152*a* and generally flatten along the latitudinal folds 152*b*.

The latitudinal folds 152*b* and the longitudinal creases 152*a* are generally concave in the extended state of the collapsible body 102 to define the recessed sidewalls 150. When the collapsible body 102 returns to the compressed state, the recessed sidewalls 150 generally collapse along the longitudinal crease 152*a*, at least partially straightening along the latitudinal folds 152*b* to define a generally planar configuration of the sidewalls 150. The concave structure of the recessed sidewalls 150 facilitates the movement of the collapsible body 102 from the compressed state to the extended state, while minimizing collapse of the collapsible body 102 about the x-axis (X). Thus, the latitudinal folds 152*b* provide both flexibility and structural integrity to the collapsible body 102. As mentioned above, the latitudinal folds 152*b* and the longitudinal creases 152*a* converge at the center point of the sidewalls 150, which translates from the concave structure to a generally planar structure as the collapsible body 102 moves between the extended state and the compressed state.

With continued reference to FIGS. 5A and 5B, the geometric structure of each of the surfaces 154*a*-154*d* forms a relief 158 along a first side 112*a* and a second side 112*b* of the collapsible body 102. Each relief 158 is interposed with each longitudinal crease 152*a*, such that the collapsible body 102 is configured to collapse along the y-axis (Y) at the longitudinal crease 152*a* to define the compressed state of the collapsible body 102. With specific reference to the recessed sidewalls 150, each surface 154*a*-154*d* has an outer crease 124*a* defining a portion of the surface 154*a*-154*d* proximate to the reliefs 158 and an inner crease 124*b* defining a portion of the longitudinal crease 152*a*. As depicted in FIG. 5A, the creases 124 of each respective surface taper from the inner crease 124*a* toward the outer crease 124*b*, such that the surfaces 154*a*-154*d* converge at a point corresponding to the hinge sets 130*a*, 130*b* of the collapsible body 102. Each of the surfaces 154*a*-154*d* defines an angle between an adjacent one of the surfaces 154*a*-154*d* about one of the longitudinal crease 152*a* and the latitudinal fold 152*b*. For example, an angle is defined about the longitudinal crease 152*a* between the first surface 154*a* and the second surface 154*a* and is smaller when the collapsible body 102 is in the compressed state as compared to the extended state. Comparatively, an angle defined between the first surface 154*a* and the third surface 154*c* about the latitudinal fold 152*b* may be greater when the collapsible body 102 is in the compressed state as compared to the extended state.

Figure 6:
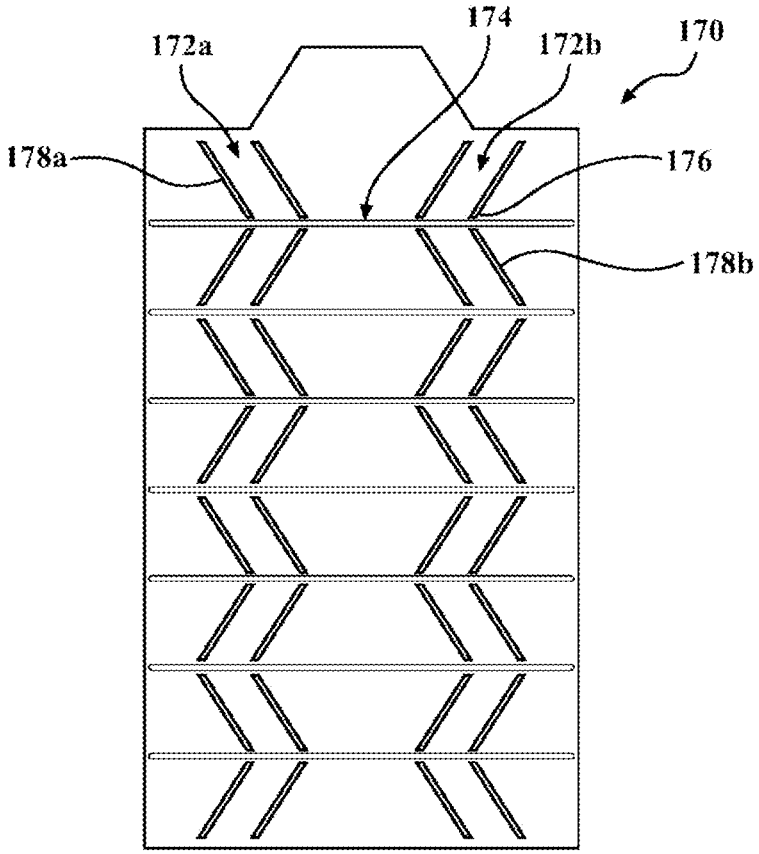
FIG. 6 is a schematic view of an infill material according to the present disclosure.
Figure 7:
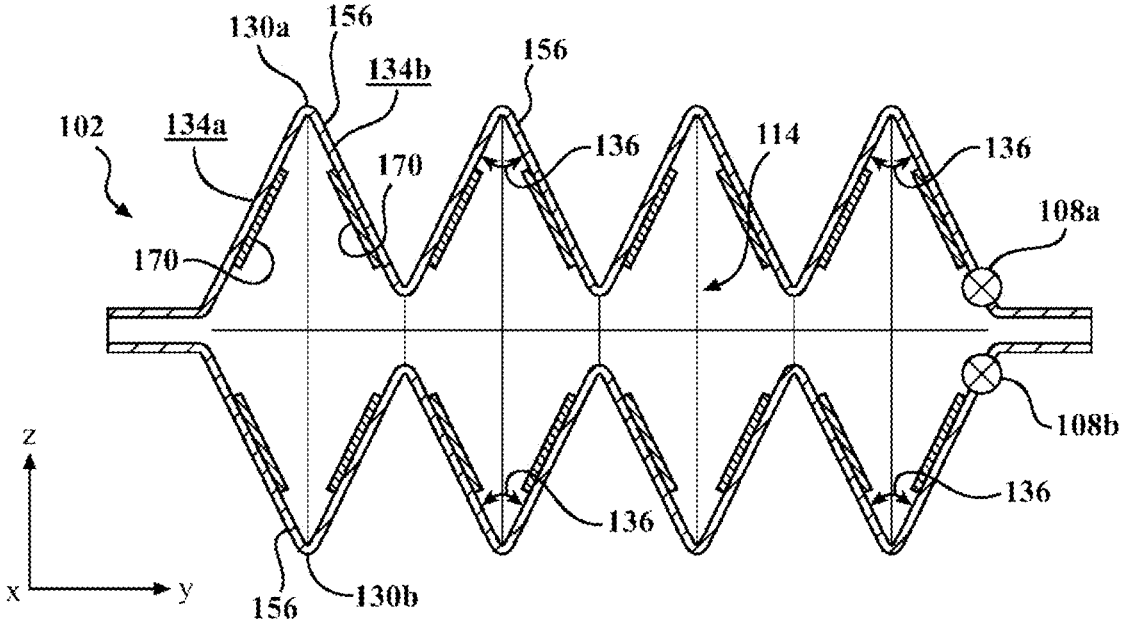
FIG. 7 is a cross-sectional view of a collapsible body according to the present disclosure.
Figure 8:
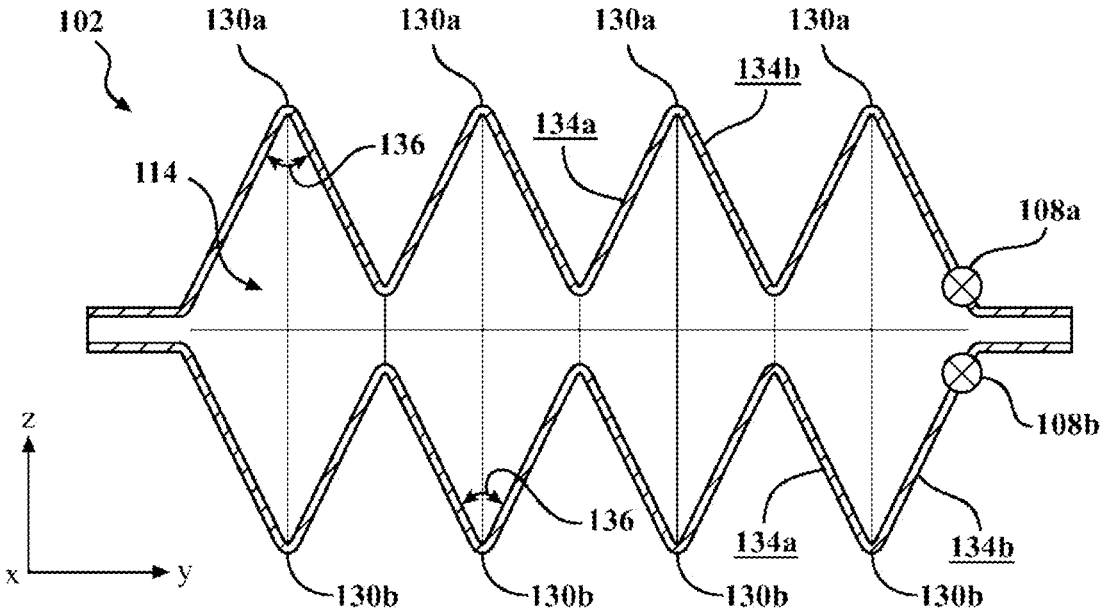
FIG. 8 is a cross-sectional view of the collapsible body of FIG. 5A, taken along Line 5C-5C of FIG. 5A.

Referring now to FIGS. 6-8, the collapsible body 102 may also include an infill material 170 having a pattern generally corresponding with that of the collapsible body 102. For example, as illustrated, the infill material 170 includes a first row of herringbone folds 172*a* and a second row of herringbone folds 172*b* with elongate folds 174 extending through peaks 176 of each of the first row of herringbone folds 172*a* and the second herringbone folds 172*b*. The pre-folded state of the infill material 170 maintains a separation between the herringbone folds 172*a*, 172*b* and the elongate folds 174 such that, in the final infill construction, the infill material 170 defined by the herringbone folds 172*a*, 172*b* remains separated from adjacent ones of the herringbone folds 172*a*, 172*b*. For example, the first row of herringbone folds 172*a* includes a first plurality of angular segments 178*a*, and the second row of herringbone folds 172*b* includes a second plurality of angular segments 178*b*.

Each of the angular segments 178*a*, 178*b* are separated by the elongate fold 174 to maintain separation between each angular segment 178*a*, 178*b*. The separation between the angular segments 178*a*, 178*b* via the elongate folds 174 results in each of the hinge sets 130*a*, 130*b* of the collapsible body 102 being free from the infill material 170 to facilitate flexion at each of the hinge sets 130*a*, 130*b* during expansion and contraction of the collapsible body 102. The infill material 170 is disposed within an interior chamber 114 of the collapsible body 102 along the recessed sidewalls 150 to provide structural stability for the collapsible body 102 and assist in maintaining the structural integrity of the collapsible body 102 in the compressed state. However, in some aspects, the collapsible body 102 may be entirely free from infill.

Materials used for the infill material 170 may include, but are not limited to, paper, wood products, nylon, PET, PP, TPU, and any practicable material having properties sufficient for bending or flexing along the sidewalls 150. The infill material 170 may having a thickness ranging from approximately 0.2 millimeters to approximately 2.0 millimeters. However, it is also contemplated that the thickness of the infill material 170 may be less than 0.2 millimeters or greater than approximately 2.0 millimeters. In some examples, soft materials (e.g., TPU materials) can be used as the infill material 170 where the sidewalls 150 have a thickness of approximately 0.5 millimeters. The infill material 170 may be an extrusion film that is die cut to define the shape of the infill material 170 with injection used to define connection bridges from one side of the material to the other.

Figure 12:
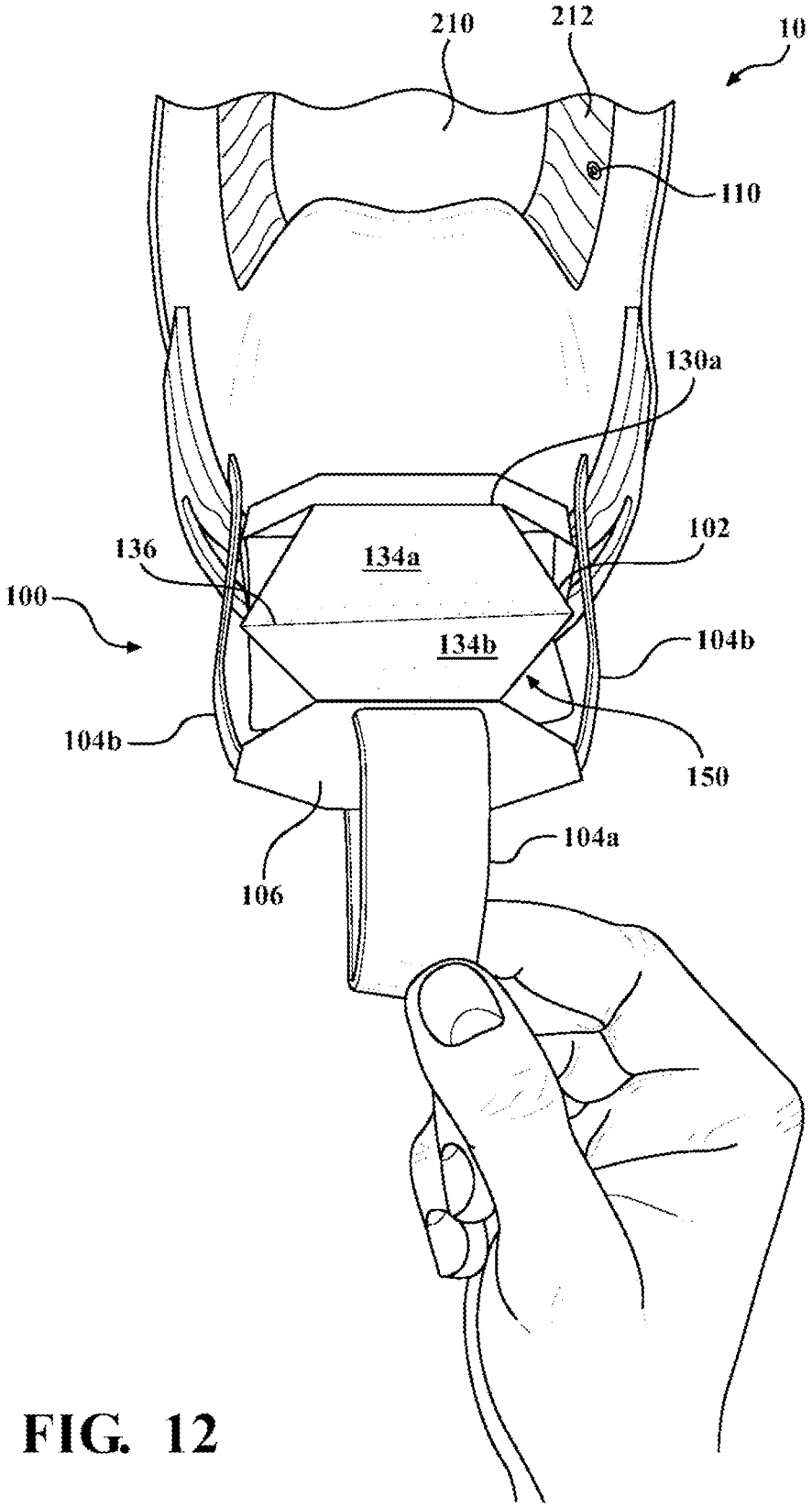
FIG. 12 is an enlarged partial top perspective view of the adjustment system of FIG. 9 in the extended state
Figure 13A:
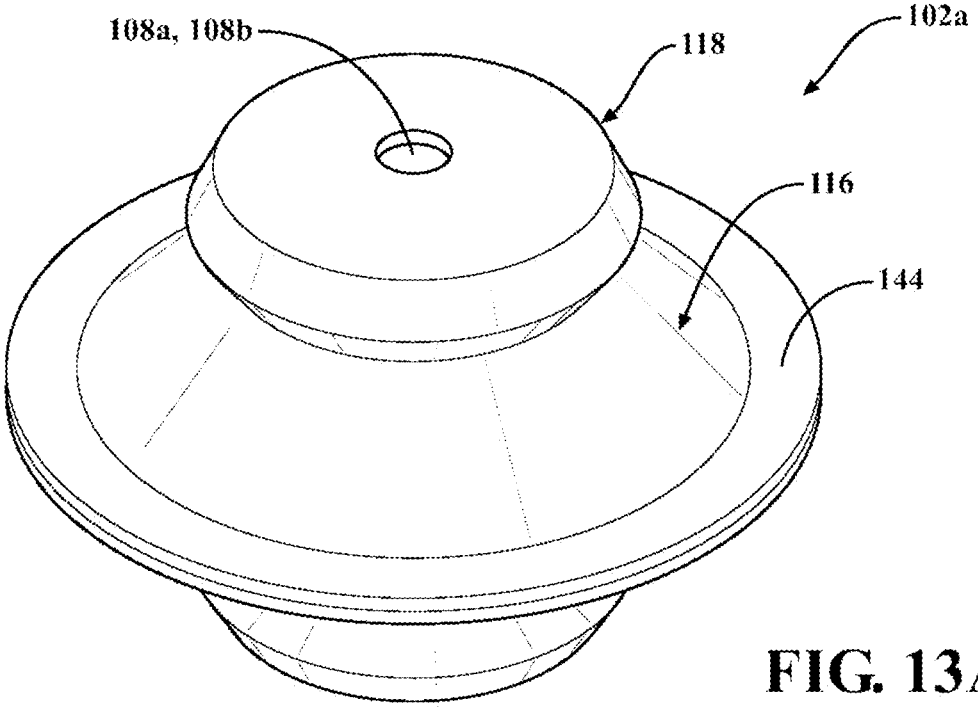
FIG. 13A is a perspective view of a collapsible body according to the present disclosure, the collapsible body in an extended state.
Figure 13B:
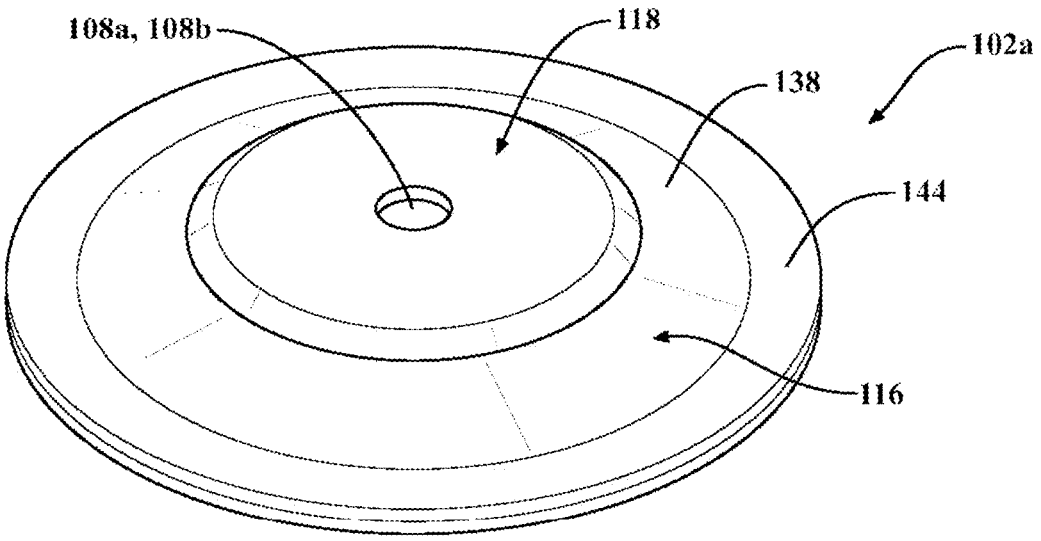
FIG. 13B is a perspective view of the collapsible body of FIG. 13A in a compressed state according to the present disclosure.
Figure 14:
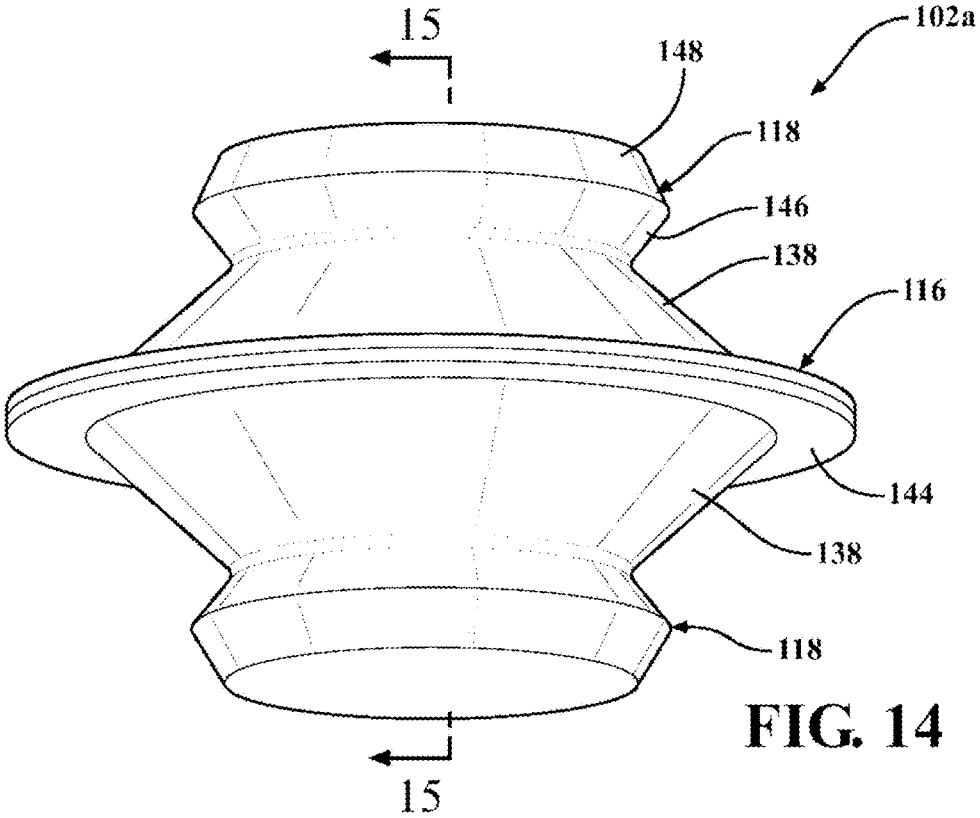
FIG. 14 is a perspective view of the collapsible body of FIG. 13A.

With specific reference to FIGS. 9-12, the collapsible body 102 is depicted as translating between the compressed state (FIG. 9) and the extended state (FIG. 12). In operation, the wearer can extend the collapsible body 102 using the actuation element 104*a* to stretch the retention elements 104*b* and expand the collapsible body 102. As the collapsible body 102 expands, the draw valve 108*a* is opened into an open condition as a result of the pressure change within the interior chamber 114 of the collapsible body 102. An at least partial vacuum is drawn within the interior void 220 of the upper 200 via the draw valve 108*a* and the expansion of the collapsible body 102. The one-way configuration of the draw valve 108*a* segregates the fluid communication back from the interior chamber 114 of the collapsible body 102 to the interior void 220 of the flex region 212 to maintain the constricted state of the flex region 212. For example, once the vacuum is drawn within the interior void 220 of the flex region 212 with the collapsible body 102 in the extended state, the draw valve 108*a* enters a closed condition to prevent backflow of the fluid into the interior void 220 of the flex region 212. The wearer may selectively adjust the degree of vacuum for the flex region 212 depending on the force and degree of extension of the collapsible body 102 when pulling the actuation element 104*a*. For example, the wearer may slowly extend the collapsible body 102 resulting in a slower vacuum draw, which may advantageously assist in customized vacuum pressure within the flex region 212 for a customized fit of the upper 200. Comparatively, the wearer may rapidly and repeatedly extend the collapsible body 102 to impart rapid, successive alteration of the flex region to achieve the customized fit over a shorter period of time.

Once the customized compression of the flex region 212 is obtained, the wearer may release the actuation element 104*a*, and the retention elements 104*b* will compress the collapsible body 102 and release the drawn fluid from the interior chamber 114. The fluid drawn from the flex region 212 through the draw valve 108*a* is retained in the interior chamber 114 of the collapsible body 102 in the extended state and is released through the expulsion valve 108*b* during compression of the collapsible body 102. The collapsible body 102 is automatically translated to the compressed state upon release of the actuation element 104*a* via the retention elements 104*b* retracting the collapsible body 102. The momentum from the retraction of the collapsible body 102 forces the fluid out of the expulsion valve 108*b* into the surrounding ambient environment. In some aspects, the wearer may press upon the collapsible body 102 to further ensure the fluid is expelled from the interior chamber 114. In other configurations, the wearer may draw the vacuum within the flex region 212 by pulling on the elastomeric member 104 and may expel the fluid from the interior chamber 114 by releasing the elastomeric member 104. As noted above, the elastomeric member 104 can include the actuation element 104*a* and the retention elements 104*b* in some configurations.

The adjustment system 100 further includes the release valve 110, which may be utilized by the wearer to translate the flex region 212 back to the relaxed state. The release valve 110 is a one-way valve configured to draw fluid from the ambient environment into the interior void 220 of the flex region 212. The fluid translates the flex region 212 from the constricted state to the relaxed state. The wearer may selectively utilize the release valve 110 to further customize the fit of the upper 200 and may, in some aspects, alternate between drawing the vacuum within the flex region 212 via the collapsible body 102 and releasing the vacuum via the release valve 110. Thus, the adjustment system 100 and flex region 212 advantageously assist the wearer in a customized fit for the upper 200 for increased versatility of use and fit of the article of footwear 10. Further, the compressed state and origami structure of the collapsible body 102 advantageously provides a low-profile of the adjustment system 100 to maintain a streamline structure of the article of footwear 10.

With particular reference to FIGS. 13A-15, a collapsible body 102*a* is provided. In view of the substantial similarity in structure and function of the components associated with the collapsible body 102, like reference numerals containing letter and number extensions are used to identify those components that have been modified.

The collapsible body 102*a* of FIGS. 13A-15 is generally configured to move between an expanded state (FIG. 13A) and a compressed state (FIG. 13B) to selectively increase and decrease a volume of an interior chamber 114*a* to draw a vacuum and expel a flow of air, respectively. The collapsible body 102*a* of the present example includes a central primary chamber 116 and a pair of secondary chambers 118 disposed at opposite ends of the primary chamber 116. The primary chamber 116 and the secondary chambers 118 cooperate to define the total volume of the interior chamber 114*a*.

The collapsible body 102*a* may be formed as a hollow body including a pair of collapsible shells 128 joined together along a peripheral seam at an intermediate portion of the collapsible body 102*a*. For example, the collapsible body 102*a* includes an identical pair of the shells 128, where each shell 128 defines a portion of the primary chamber 116 and one of the secondary chambers 118. Thus, the shells 128 cooperate to define opposite halves of the collapsible body 102*a*. In the illustrated example, each shell 128 is a molded component, whereby the features of the secondary chamber 118 are integrally molded with each other and a portion of the primary chamber 116.

Figure 15:
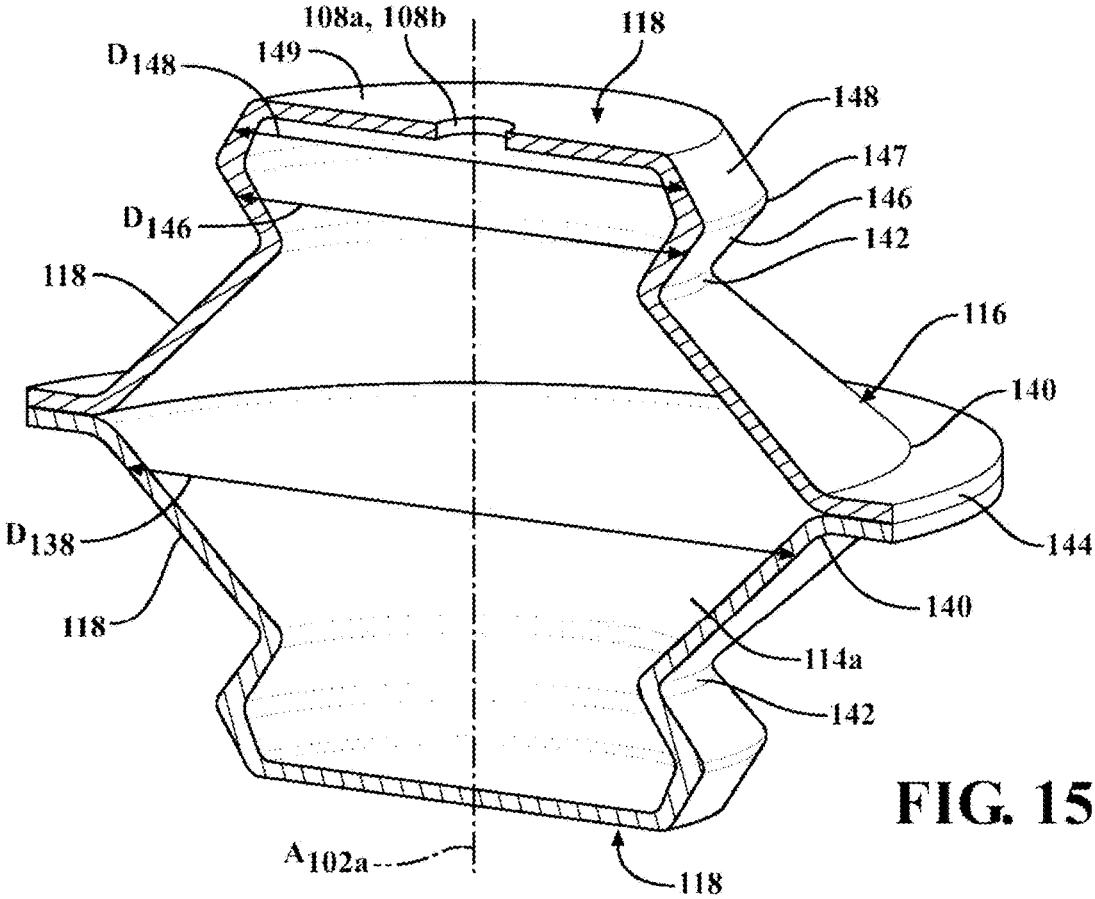
FIG. 15 is a perspective, cross-sectional view of the collapsible body of FIG. 14.
Figure 16A:
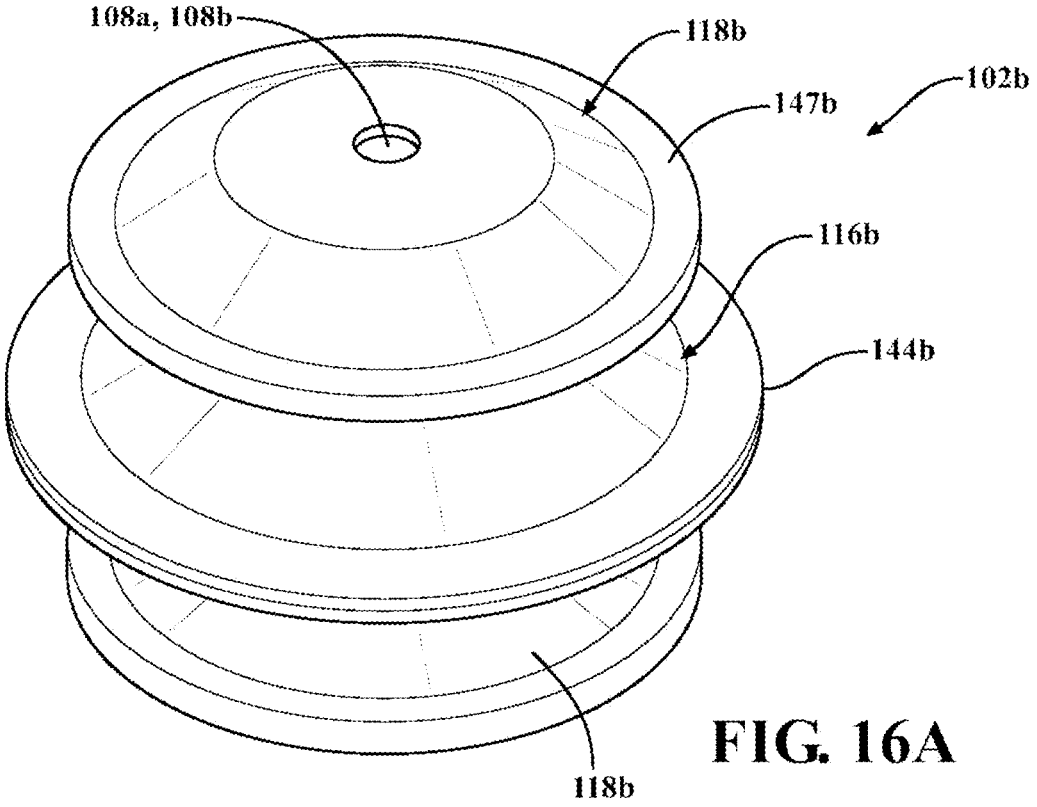
FIG. 16A is a perspective view of a collapsible body according to the present disclosure in an extended state.
Figure 16B:
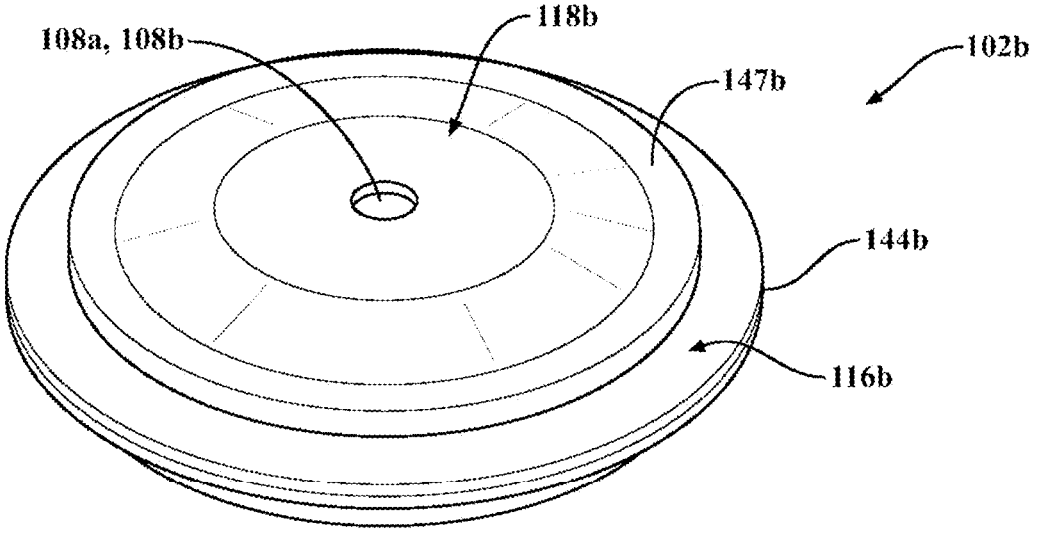
FIG. 16B is a perspective view of the collapsible body of FIG. 16A in a compressed state according to the present disclosure.
Figure 17:
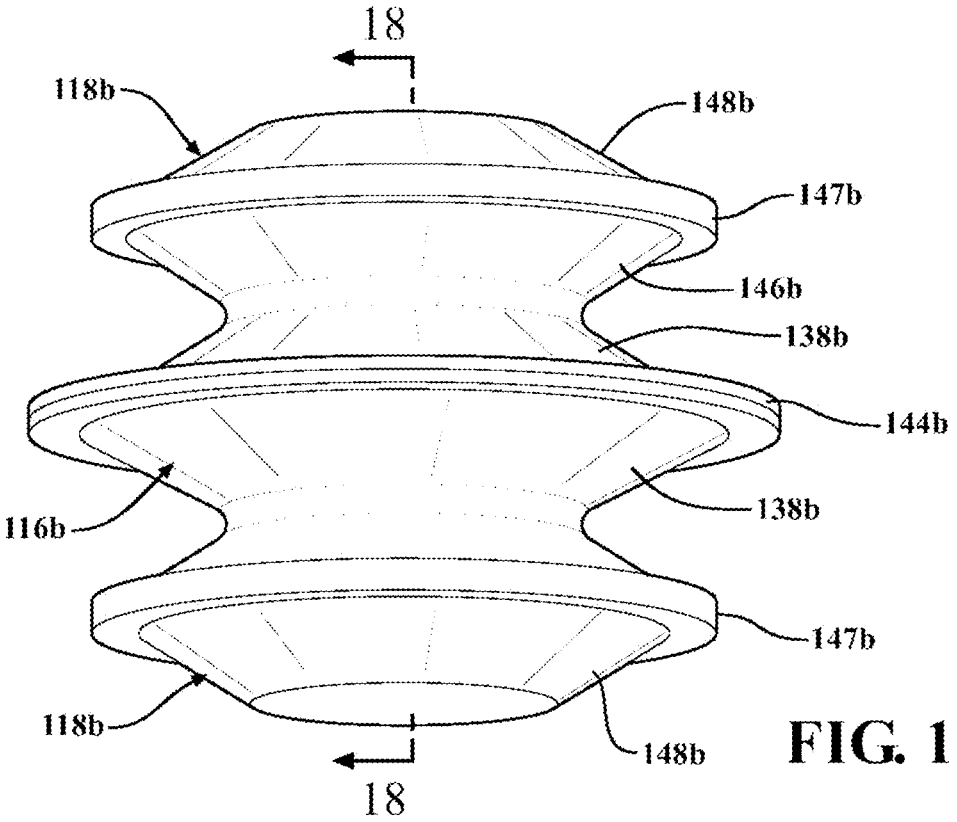
FIG. 17 is a perspective view of the collapsible body of FIG. 16A.

In the illustrated example, the primary chamber 116 is configured as a double frustoconical structure. In other words, the primary chamber 116 is defined by an opposing pair of primary sidewalls 138 each having frustoconical shape, whereby a diameter $D_{138}$ of each primary sidewall 138 tapers along a direction of a longitudinal axis $A_{102a}$ of the collapsible body 102*a* from a proximal first end 140 to a distal second end 142. Thus, as shown in FIG. 15, the proximal first end 140 of a first sidewall 138 of the primary chamber 116 faces and is attached to the proximal first end 140 of a second sidewall 138 of the primary chamber 116. As shown, the first ends 140 of the first primary sidewalls 138 may be joined to each other along a peripheral flange 144. Particularly, the peripheral flange 144 extends radially outwardly from the proximal first end 140 of each primary sidewall 138 and provides a welding interface for joining the first ends 140 of the primary sidewalls 138 to each other.

Similar to the primary chamber 116, each of the secondary chambers 118 is configured as a double frustoconical structure disposed at the distal second end 142 of each of the primary sidewalls 138 of the primary chamber 116. Thus, the collapsible body 102*a* includes a first secondary chamber 118 disposed at the distal second end 142 of a first one of the primary sidewalls 138 of the primary chamber 116 and another secondary chamber 118 disposed at the distal second end 142 of the other one of the primary sidewalls 138 of the primary chamber 116. While the illustrated example shows a single secondary chamber 118 at each end of the primary chamber 116, it should be appreciated that any number of secondary chambers 118 may be included at each end of the primary chamber 116 depending on a desired volume for the interior chamber 114*a* of the collapsible body 102*a*. For example, either or both ends of the collapsible body 102*a* may include a plurality of the secondary chambers 118.

As shown, each secondary chamber 118 is defined by an opposing pair of frustoconical secondary sidewalls 146, 148 each having a tapering diameter $D_{146}$, $D_{148}$ along the direction of the longitudinal axis $A_{102a}$ of the collapsible body 102*a*. Particularly, each secondary chamber 118 includes a proximal sidewall 146 extending from the distal second end 142 of one of the primary sidewalls 138 of the primary chamber 116 and a distal sidewall 148 extending from the proximal sidewall 146. In other words, the proximal sidewall 146 of each secondary chamber 118 is proximal or adjacent to the primary chamber 116 and the distal sidewall 148 of each secondary chamber 118 is distal to or spaced from the primary chamber 116. The diameter $D_{146}$ of each proximal sidewall 146 increases along the direction of the longitudinal axis $A_{102a}$ from the distal second end 142 of the sidewall 138 to a crease or flex joint 147 formed between proximal sidewall 146 and the distal sidewall 148. Conversely, the diameter $D_{148}$ of the distal sidewall 148 decreases along the direction of the longitudinal axis $A_{102a}$ from the flex joint 147 to a terminal end 149 of the secondary chamber 118.

In the illustrated example, the secondary sidewalls 146, 148 are each formed with a maximum diameter $D_{146}$, $D_{148}$ at the flex joint 147 that is less than a maximum diameter $D_{138}$ of the primary sidewalls 138 at the proximal first end 140 of each primary sidewall 138. Thus, the flex joint 147 is offset radially inwardly relative to the proximal first end 140 of each respective primary sidewall 138. Accordingly, the flex joint 147 is offset radially inwardly from the peripheral flange 144 of the collapsible body 102*a*. The offset relationship between the flex joint 147 and the peripheral flange 144 allows direct access to opposite sides of the peripheral flange 144 along the direction of the longitudinal axis $A_{102a}$ to permit welding equipment to contact both sides of the peripheral flange 144 during manufacturing. When the collapsible body 102*a* includes a plurality of the secondary chambers 118 disposed on either side of the primary chamber 116, the diameters of the secondary chambers 118 are selected such that welding access to the peripheral flange 144 remains unobstructed. In other words, each of the secondary chambers 118 will have a diameter that is less than the diameter of the peripheral flange 144.

In use, the collapsible body 102*a* is moved between an expanded state (FIG. 13A) and a collapsed or compressed state (FIG. 13B) draw and expel a flow of air into and out of the chamber 114*a* through one or more of the valves 108*a*, 108*b* configured in a similar manner as the valves 108*a*, 108*b* discussed previously. Thus, the collapsible body 102*a* is moved to the expanded state to draw air into the chamber 114*a* through an intake or draw valve 108*a* and moved to the compressed or collapsed state to expel air through the expulsion valve 108*b*. The valves 108*a*, 108*b* may be integrated into either one or both of the secondary chambers 118 of the collapsible body 102*a*.

With particular reference to FIGS. 16A-18, a collapsible body 102*b* is provided. In view of the substantial similarity in structure and function of the components associated with the collapsible body 102, like reference numerals containing letter and number extensions are used to identify those components that have been modified.

The collapsible body 102*b* of FIGS. 16A-18 is generally configured to move between an expanded state (FIG. 16A) and a compressed state (FIG. 16B) to selectively increase and decrease a volume of an interior chamber 114*b* to draw a vacuum and expel a flow of air, respectively. The collapsible body 102*b* of the present example includes a central primary chamber 116*b* and a pair of secondary chambers 118*b* disposed at opposite ends of the central primary chamber 116*b*. The primary chamber 116*b* and the secondary chambers 118*b* cooperate to define the total volume of the interior chamber 114*b*.

The collapsible body 102*b* may be formed as a hollow body including a pair of collapsible shells 128*b* joined together along a peripheral seam at an intermediate portion of the collapsible body 102*a*. For example, the collapsible body 102*b* includes an identical pair of the shells 128*b*, where each shell 128*b* defines a portion of the primary chamber 116*b* and one of the secondary chambers 118*b*. Thus, the shells 128*b* cooperate to define opposite halves of the collapsible body 102*b*. In the illustrated example, each shell 128 is a molded component, whereby the features of the secondary chamber 118*b* are integrally molded with each other and a portion of the primary chamber 116*b*.

Figure 18:
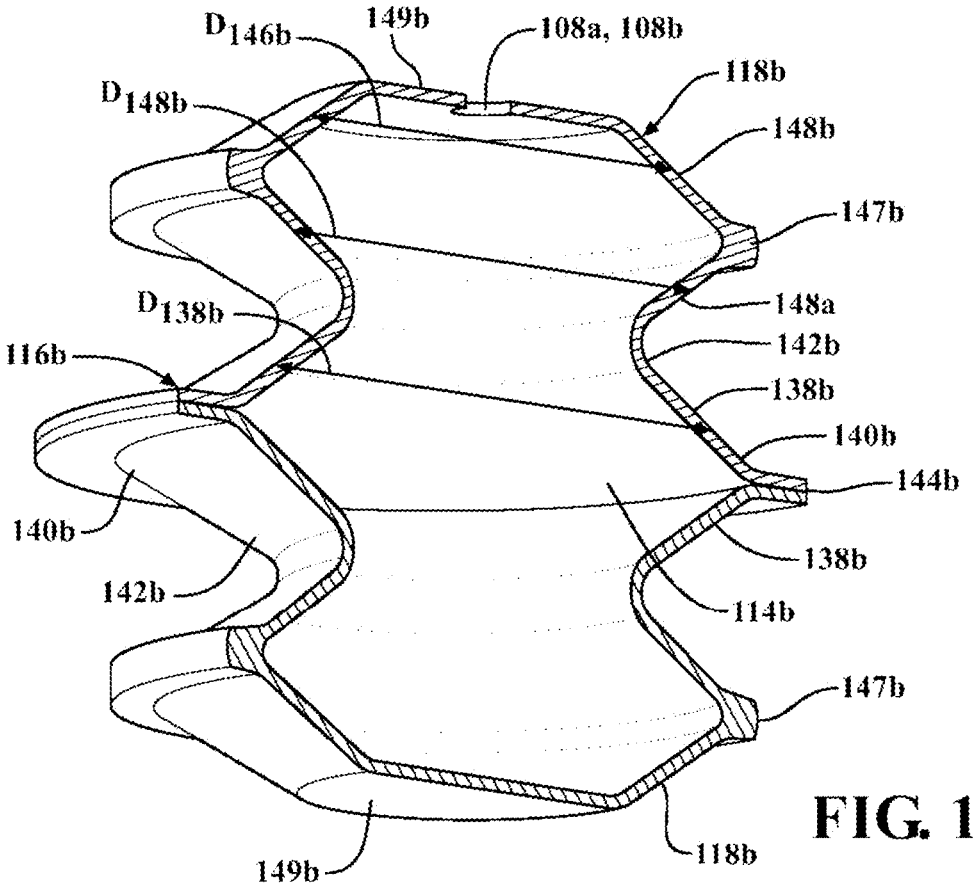
FIG. 18 is a perspective, cross-sectional view of the collapsible body of FIG. 17.
Figure 19A:
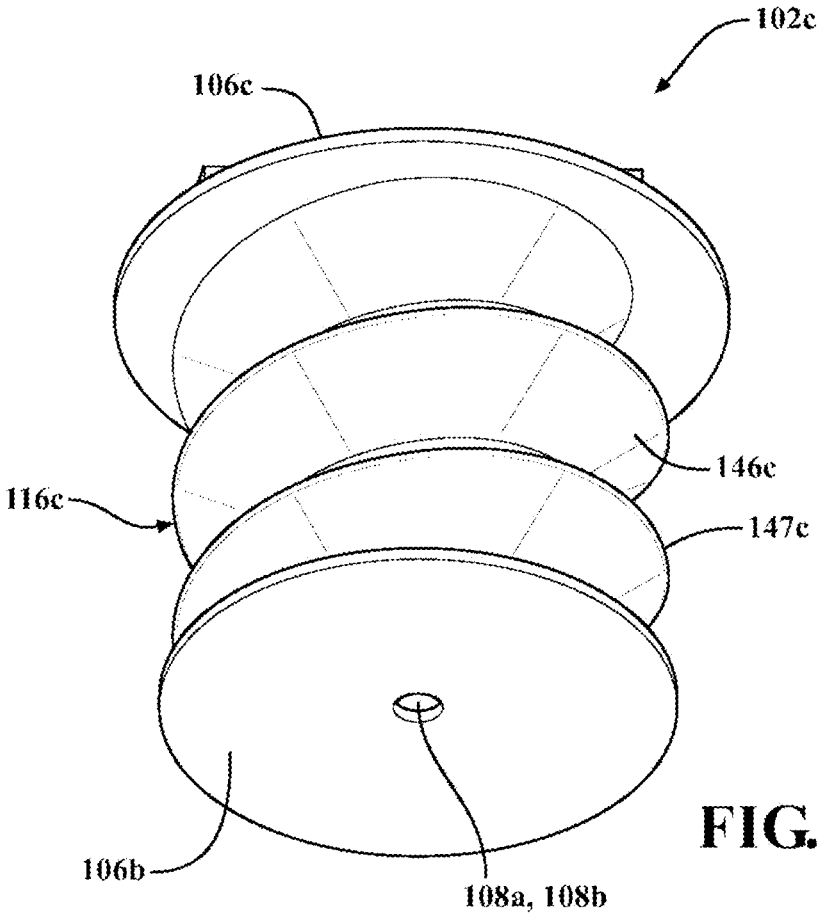
FIG. 19A is a perspective view of a collapsible body according to the present disclosure in an extended state.
Figure 19B:
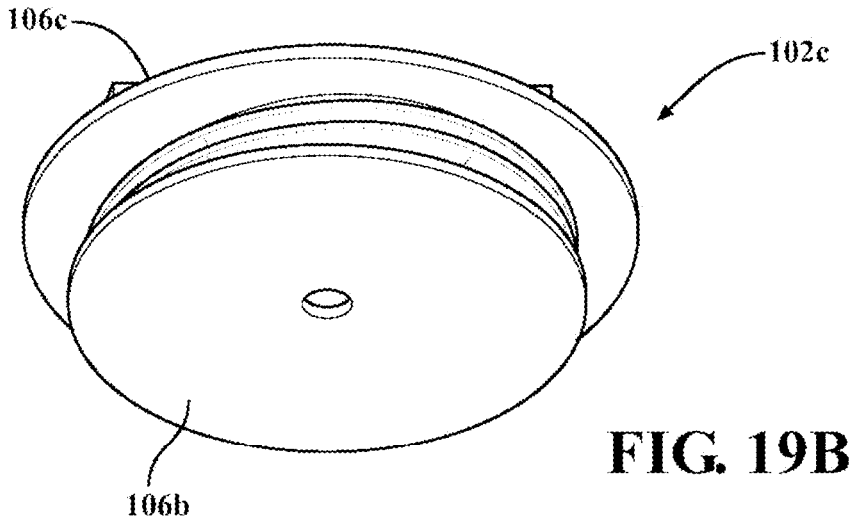
FIG. 19B is a perspective view of the collapsible body of FIG. 19A in a compressed state according to the present disclosure.
Figure 20:
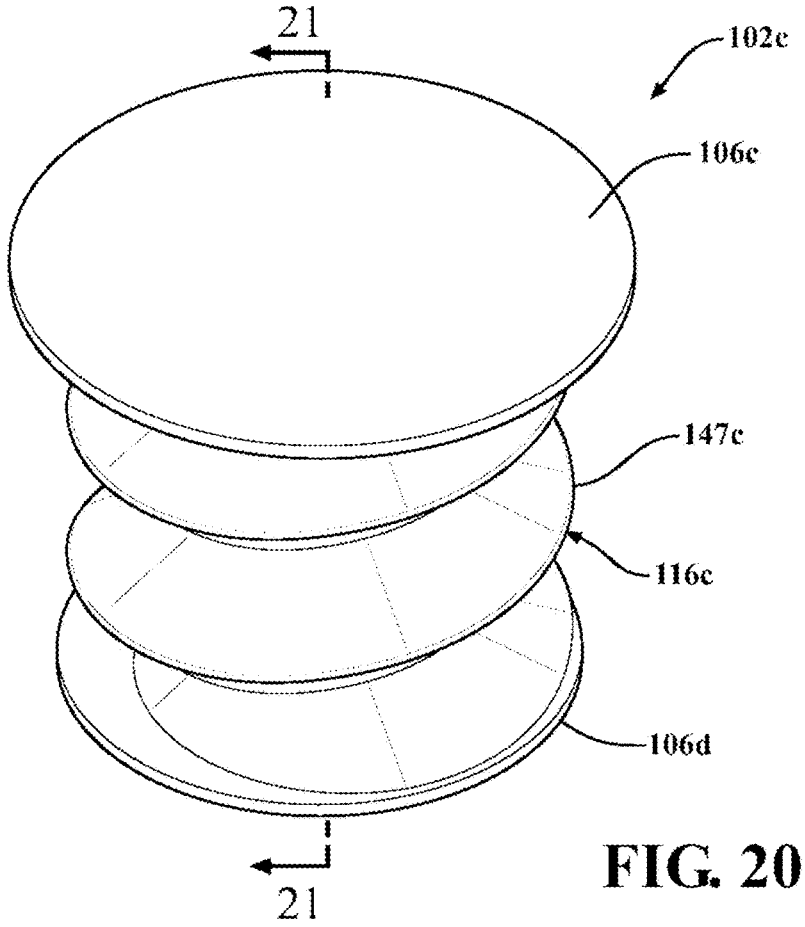
FIG. 20 is a perspective view of the collapsible body of FIG. 19A.

In the illustrated example, the primary chamber 116*b* is configured as a double frustoconical structure. In other words, the primary chamber 116*b* is defined by opposing pair of primary sidewalls 138*b* each having frustoconical shape, whereby a diameter $D_{358b}$ of each primary sidewall 138*b* tapers along a direction of a longitudinal axis $A_{102b}$ of the collapsible body 102*b* from a proximal first end 140*b* to a distal second end 142*b*. Thus, as shown in FIG. 18, the proximal first end 140*b* of a first primary sidewall 138*b* of the primary chamber 116*b* faces and is attached to the proximal first end 140*b* of a second primary sidewall 138*b* of the primary chamber 116*b*. As shown, the first ends 140*b* of the first primary sidewalls 138*b* may be joined to each other along a peripheral flange 144*b*. Particularly, the peripheral flange 144*b* extends radially outwardly from the proximal first end 140*b* of each primary sidewall 138*b* and provides a welding interface for joining the first ends 140*b* of the primary sidewalls 138*b* to each other.

Similar to the primary chamber 116*b*, each of the secondary chambers 118*b* is configured as a double frustoconical structure disposed at the distal second end 142*b* of each of the primary sidewalls 138*b* of the primary chamber 116*b*. Thus, the collapsible body 102*a* includes a first secondary chamber 118*b* disposed at the distal second end 142*b* of a first one of the primary sidewalls 138*b* of the primary chamber 116*b* and another secondary chamber 118*b* disposed at the distal second end 142*b* of the other one of the primary sidewalls 138*b* of the primary chamber 116*b*. While the illustrated example shows a single secondary chamber 118*b* at each end of the primary chamber 116*b*, it should be appreciated that any number of secondary chambers 118*b* may be included at each end of the primary chamber 116*b* depending on a desired volume for the interior chamber 114*b* of the collapsible body 102*b*. For example, either or both ends of the collapsible body 102*b* may include a plurality of the secondary chambers 118*b*.

As shown, each secondary chamber 118*b* is defined by an opposing pair of frustoconical secondary sidewalls 146*b*, 148*b* each having a tapering diameter $D_{146b}$, $D_{148b}$ along the direction of the longitudinal axis $A_{102b}$ of the collapsible body 102*b*. Particularly, each secondary chamber 118*b* includes a proximal sidewall 146*b* extending from the distal second end 142*b* of one of the primary sidewalls 138*b* of the primary chamber 116*b* and a distal sidewall 148*b* extending from the proximal sidewall 146*b*. In other words, the proximal sidewall 146*b* of each secondary chamber 118*b* is proximal or adjacent to the primary chamber 116*b* and the distal sidewall 148*b* of each secondary chamber 118*b* is distal to or spaced from the primary chamber 116*b*. The diameter $D_{146b}$ of the proximal sidewall 146*b* increases along the direction of the longitudinal axis $A_{102b}$ from the distal second end 142*b* of the sidewall 138*b* to a crease or flex joint 147*b* formed between proximal sidewall 146*b* and the distal sidewall 148*b*. Conversely, the diameter $D_{148b}$ of the distal sidewall 148*b* decreases along the direction of the longitudinal axis $A_{102b}$ from the flex joint 147*b* to a terminal end 149*b* of the secondary chamber 118*b*.

In the illustrated example, the secondary sidewalls 146*b*, 148*b* are each formed with a maximum diameter $D_{146b}$, $D_{148b}$ at the flex joint 147*b* that is less than a maximum diameter $D_{138b}$ of the primary sidewalls 138*b* at the proximal first end 140*b* of each primary sidewall 138*b*. Thus, the flex joint 147*b* is offset radially inwardly relative to the proximal first end 140*b* of each respective primary sidewall 138*b*. Accordingly, the flex joint 147*b* is offset radially inwardly from the peripheral flange 144*b* of the collapsible body 102*b*. The offset relationship between the flex joint 147*b* and the peripheral flange 144*b* allows direct access to opposite sides of the peripheral flange 144*b* along the direction of longitudinal axis $A_{102a}$ to permit welding equipment to contact both sides of the peripheral flange 144*b* during manufacturing. When the collapsible body 102*a* includes a plurality of the secondary chamber 118*b* disposed on either side of the primary chamber 116*b*, the diameters of the secondary chambers 118 are selected such that welding access to the peripheral flange 144*b* remains unobstructed.

In use, the collapsible body 102*b* is moved between an expanded state (FIG. 16A) and a collapsed or compressed state (FIG. 16B) draw and expel a flow of air into and out of the chamber 114*b* through one or more of the valves 108*a*, 108*b* configured in a similar manner as the valves 108*a*, 108*b* discussed previously. Thus, the collapsible body 102*b* is moved to the expanded state to draw air into the chamber 114*a* through an intake or draw valve 108*a* and moved to the compressed or collapsed state to expel air through the expulsion valve 108*b*. The valves 108*a*, 108*b* may be integrated into either one or both of the secondary chambers 118*b* of the collapsible body 102*b*.

With particular reference to FIGS. 19A-21, a collapsible body 102*c* is provided. In view of the substantial similarity in structure and function of the components associated with the collapsible body 102, like reference numerals containing letter and number extensions are used to identify those components that have been modified.

The collapsible body 102*c* of FIGS. 19A-21 is generally configured to move between an expanded state (FIG. 19A) and a collapsed state (FIG. 19B) to selectively increase and decrease a volume of an interior chamber 114*c* to draw a vacuum and expel a flow of air, respectively. The collapsible body 102*c* of the present example includes a primary chamber 116*c* having a helical profile extending continuously from a first end 106*c* of the collapsible body 102*c* to a second end 106*d*, whereby the primary chamber 116*c* can be moved from the expanded state to draw a flow of air into the interior chamber 114*c* and to the collapsed state to expel the flow of air from the interior chamber 114*c*.

The collapsible body 102*c* may be formed as a hollow body including a continuous shell 128*c*. The shell 128*c* may be a unitary body molded from an elastomeric material. In the illustrated example, the helical profile of the collapsible body 102*c* is defined by a first sidewall 146*c* and a second sidewall 148*c* joined together along an outer flex joint 147*c* and an inner flex joint 147*d* and extending continuously along a helical path from the first end 106*c* to the second end

Figure 21:
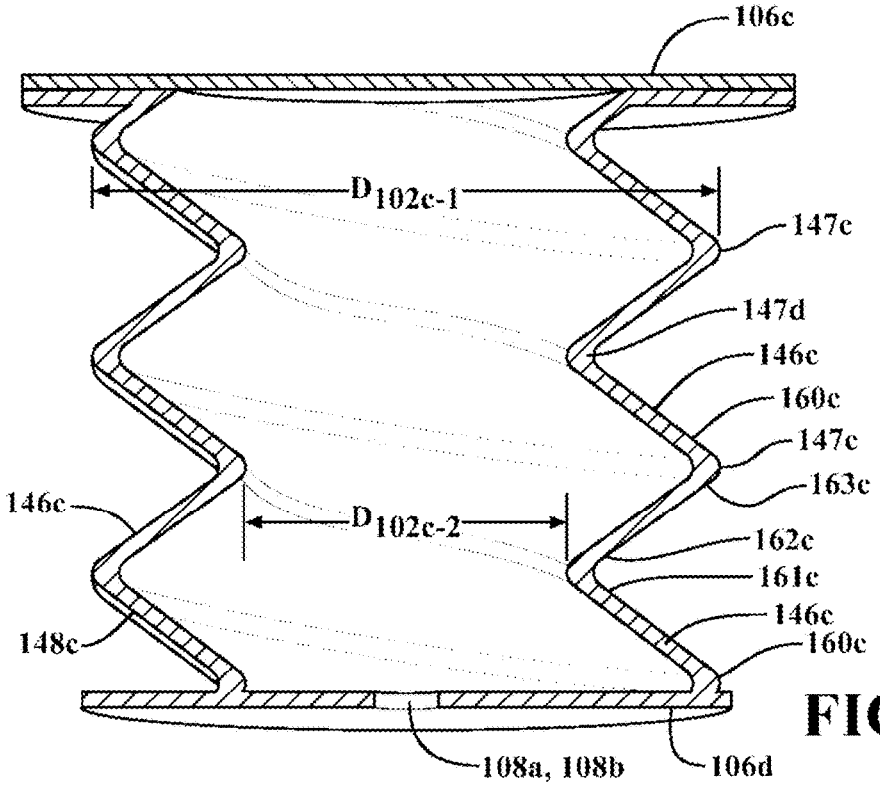
FIG. 21 is a perspective, cross-sectional view of the collapsible body of FIG. 20.
Figure 22:
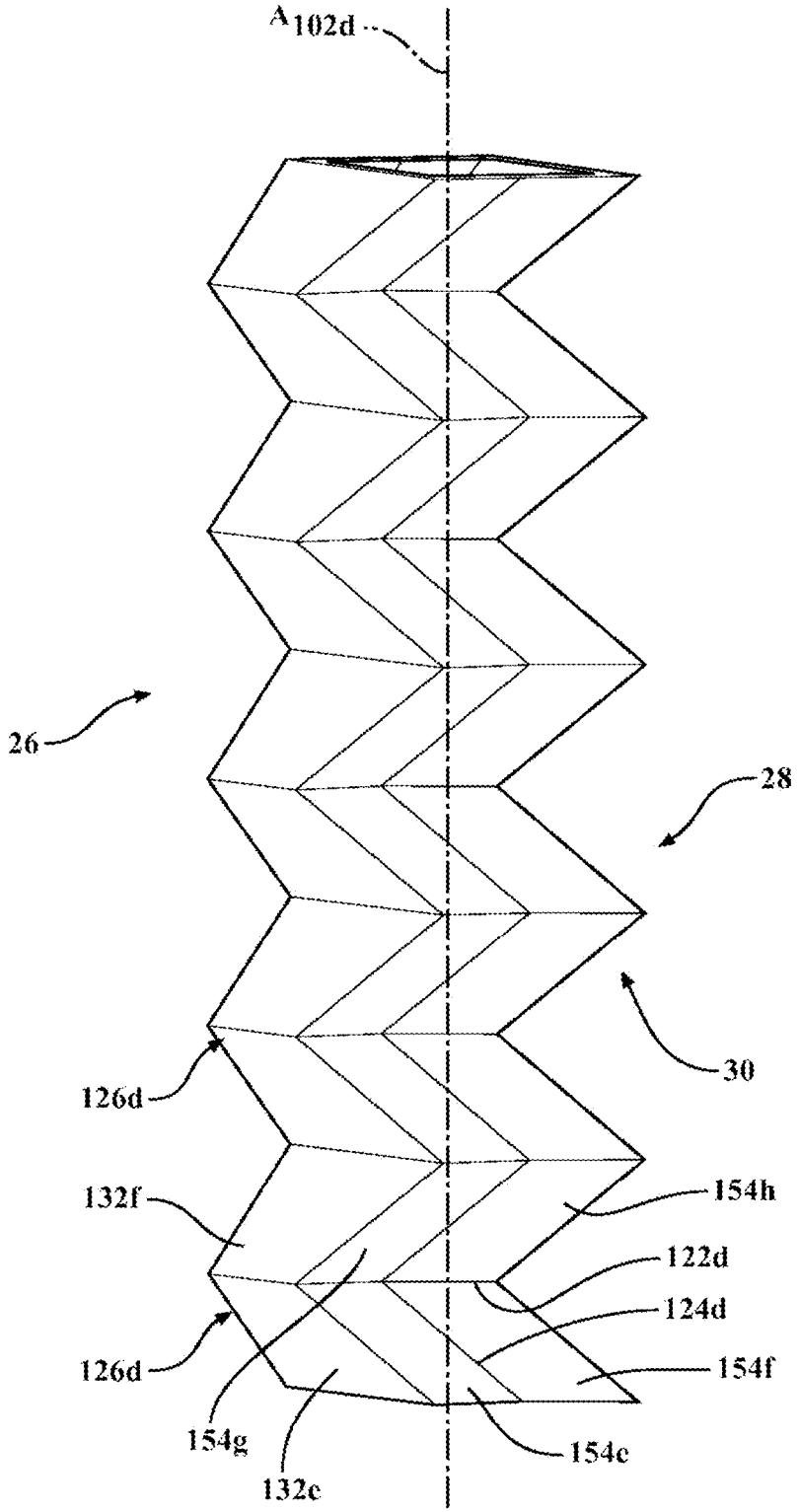
FIG. 22 is a perspective view of a collapsible body according to the present disclosure in an extended state.

106*d*. Thus, each of the sidewalls 146*c*, 146*d* and the flex joints 147*c*, 147*d* extend continuously along the helical path to define the collapsible body 102*c*. As best shown in FIG. 21, the first sidewall 146*c* is oriented at an oblique angle relative to the longitudinal axis $A_{102}$, and extends from an outer first end 160*c* to an inner second end 161*c*. The second sidewall 148*c* is oriented at an opposite angle relative to the longitudinal axis $A_{102}$, and extends from an inner first end 162*c* to an outer second end 163*c*. As shown, the outer second end 163*c* of the second sidewall 148*c* attaches to the outer first end 160*c* of the first sidewall 146*c* at the outer flex joint 147*c*. Similarly, the inner first end 162*c* of the second sidewall 148*c* is attached to the inner second end 161*c* of the first sidewall 146*c* at an inner flex joint 147*d*. Thus, the sidewalls 146*c*, 148*c* and the flex joints 147*c*, 147*d* form an alternating arrangement along the length of the collapsible body 102*c*, whereby each sidewall 146*c*, 148*c* and flex joint 147*c*, 147*d* extends continuously along a circumference of the collapsible body 102*c* along the helical path.

In the illustrated example, the collapsible body 102*c* has a major diameter $D_{102c\text{-}1}$ measured as the distance across the longitudinal axis $A_{102c}$ of the outer flex joint 147*c* and a minor diameter $D_{102c\text{-}2}$ measured as the distance across the longitudinal axis $A_{102c}$ of the inner flex joint 147*d*. In this example, the diameters $D_{102c\text{-}1}$, $D_{102c\text{-}2}$ are substantially constant from the first end 106*c* to the second end 106*d*. However, in some examples, the collapsible body 102*c* may be formed with a draft angle, whereby the diameters $D_{102c\text{-}1}$, $D_{102c\text{-}2}$ progressively increase or decrease along the direction from the first end 106*c* to the second end 106*d* to accommodate removal of the collapsible housing 102*c* from a mold cavity during manufacturing.

In use, the collapsible body 102*c* is moved between an expanded state (FIG. 19A) and a collapsed or compressed state (FIG. 19B) to draw and expel a flow of air into and out of the chamber 114*b* through one or more of the valves 108*a*, 108*b* configured in a similar manner as the valves 108*a*, 108*b* discussed previously. Thus, the collapsible body 102*c* is moved to the expanded state to draw air into the chamber 114*c* through an intake or draw valve 108*a* and moved to the compressed or collapsed state to expel air through the expulsion valve 108*b*. The valves 108*a*, 108*b* may be integrated into either one or both ends 106*c*, 106*d* of the collapsible body 102*c*.

With particular reference to FIGS. 22-25, a collapsible body 102*d* is provided. In view of the substantial similarity in structure and function of the components associated with the collapsible body 102, like reference numerals containing letter and number extensions are used to identify those components that have been modified. For the sake of describing the geometries of the collapsible body 102*d*, the collapsible body 102*d* may be referred to relative to a front side 26, a rear side 28, a left side 30, and a right side 32. However, these designations are intended solely for the sake of describing relative geometries of the collapsible body 102*d* and do not limit the use or orientation of the collapsible body 102.

Figure 24:
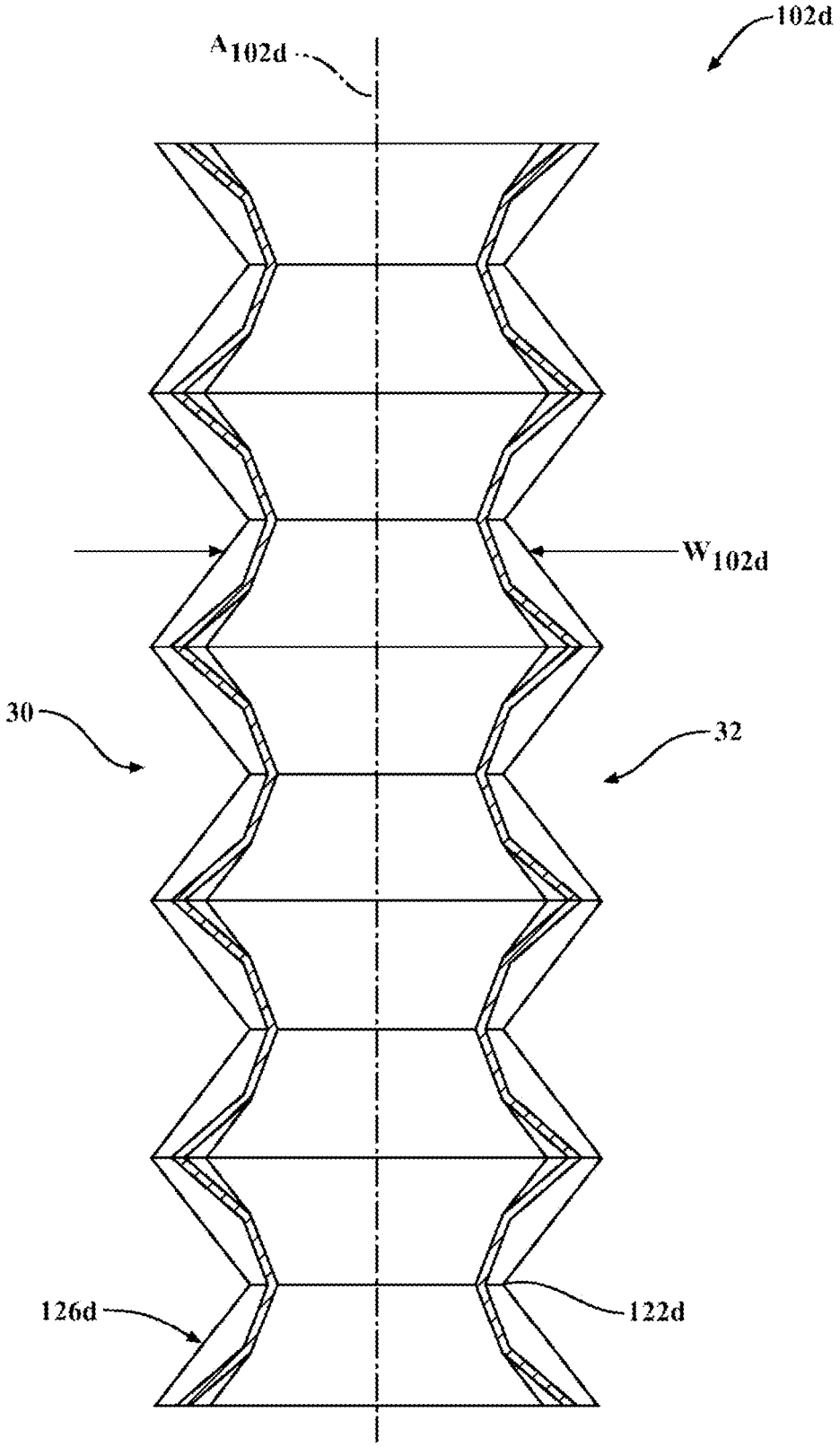
FIG. 24 is a cross-sectional view of the collapsible body of FIG. 22, taken along Line 24-24 of FIG. 22.
Figure 25:
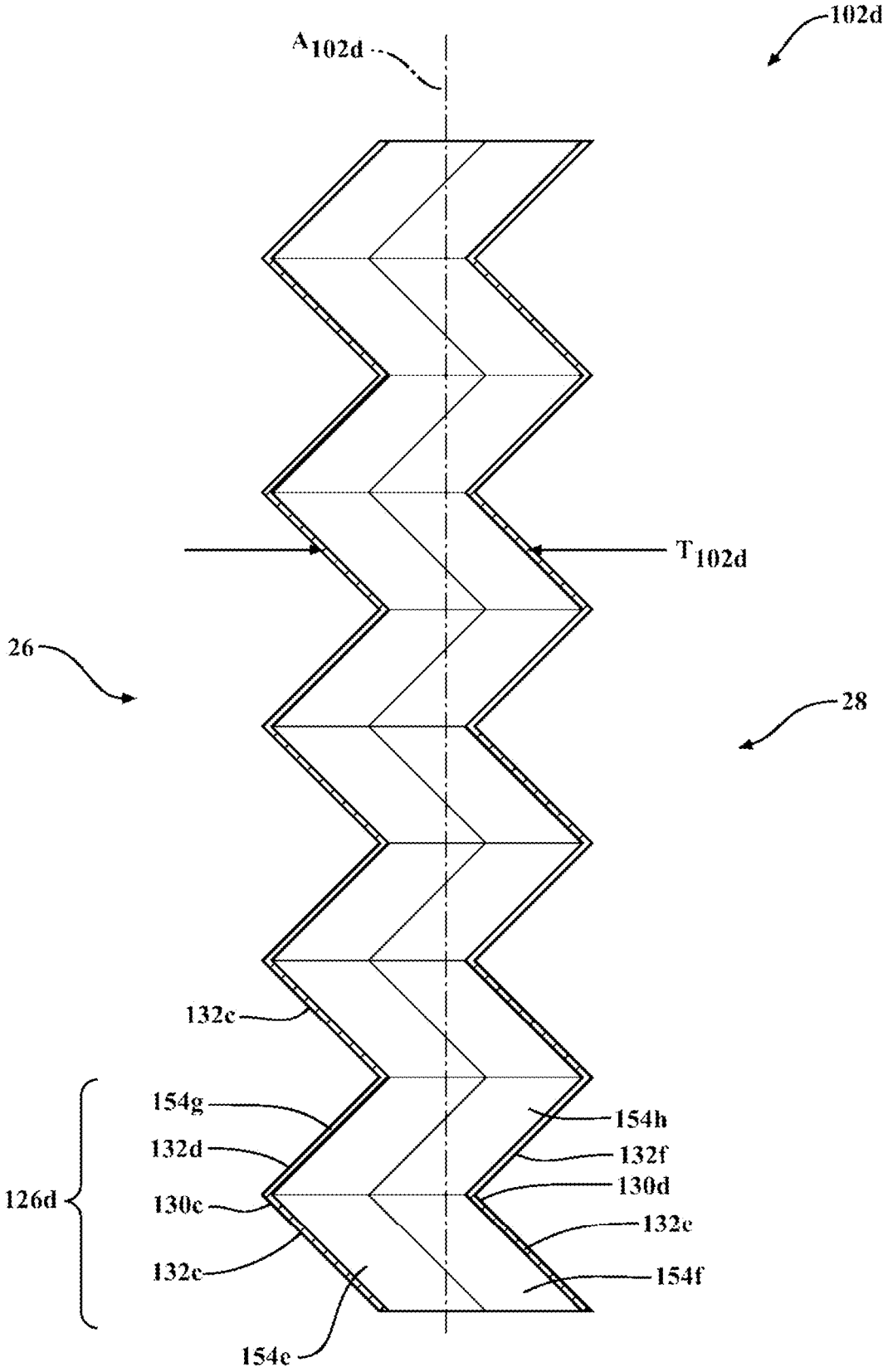
FIG. 25 is a cross-sectional view of the collapsible body of FIG. 22, taken along Line 25-25 of FIG. 23.

The collapsible body 102*d* is the present example is configured in a similar fashion as the collapsible body 102 previously described. However, in this example, the collapsible body 102*d* includes a plurality of a segments 126*d* arranged in series along a longitudinal axis $A_{102d}$. Similar to the collapsible body 102, described previously, each segment 126*d* of the collapsible body 102*d* includes a plurality of joints (i.e., folds) for allowing each segment 126*d* to collapse upon itself and adjacent ones of the segments 126*d*. As shown in FIGS. 24 and 25, each segment 126*d* and the collapsible body 102*d* may be described with respect to a width $W_{102d}$ and a thickness $T_{102d}$, each measured across the longitudinal axis $A_{102d}$ of the collapsible body. As discussed in greater detail below, the width $W_{102d}$ of each segment 126*d* is defined across opposing pairs of side surfaces 154*e*-154*h* while the thickness $T_{102d}$ of each segment 126*d* is defined across opposing pairs (i.e., front and rear) of interface surfaces 132*c*, 132*d*.

Figure 23:
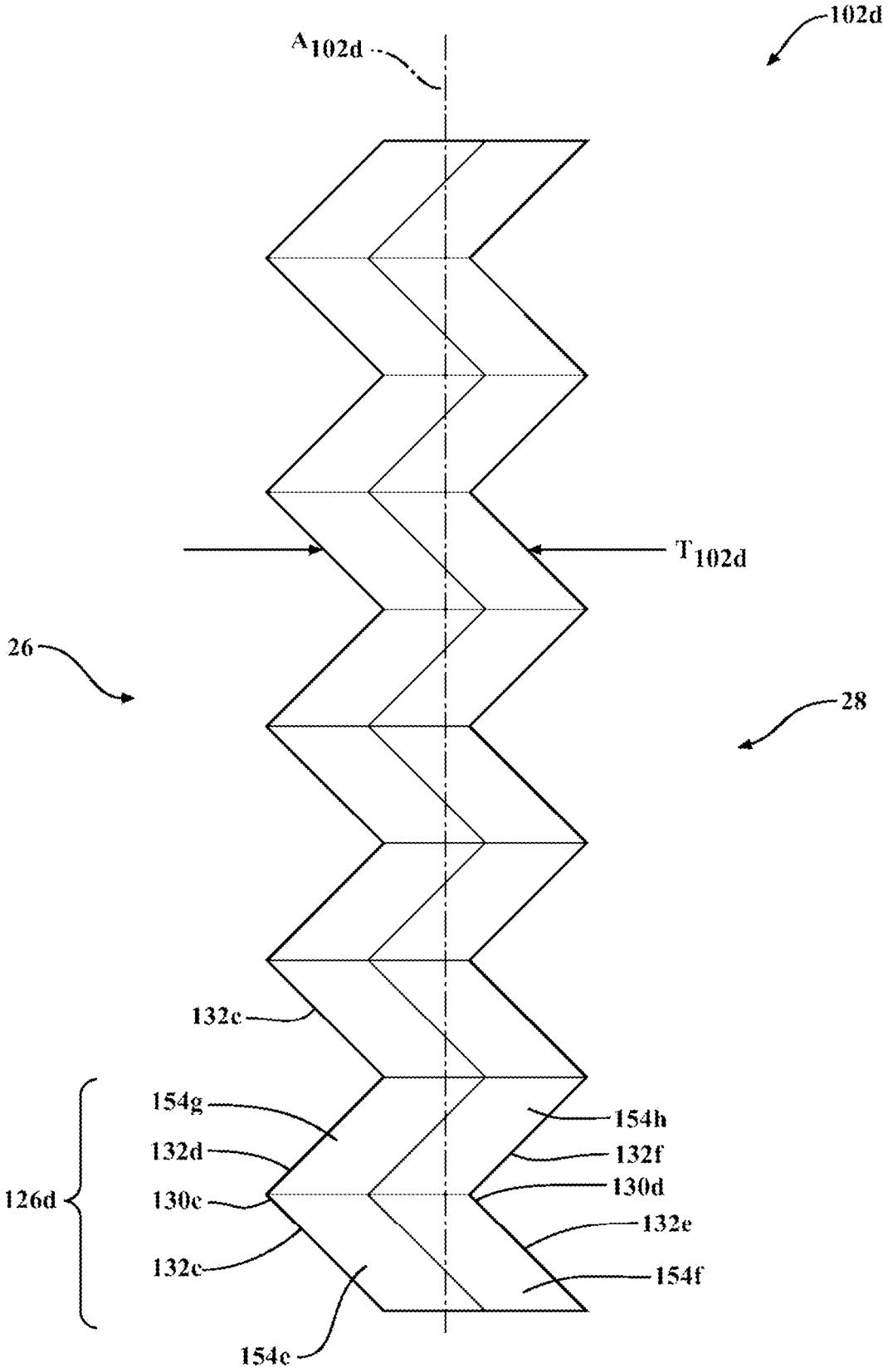
FIG. 23 is a front elevation view of the collapsible body of FIG. 22.

With reference to FIG. 23, a lateral side elevation view of the collapsible body 102*d* shows an arrangement of the segments 126*d* forming the collapsible body 102*d*. As shown, the side of each segment 126*d* includes a plurality of the side surfaces 154*e*-154*h* joined together at a plurality of interior joints or folds 122*d*, 124*d* that facilitate movement between the expanded state and the collapsed state. Particularly, adjacent ones of the surfaces 154*e*-154*h* of each segment 126*d* are joined together along a horizontal joint 122*d* and a respective vertical joint 124*d*. Thus, the faces 154*e*-154*h* may include a pair of lower faces 154*e*, 154*f* positioned on a bottom side of the horizontal joint 122*d* and joined together along a lower portion of the vertical joint 124*d*. The faces 154*e*-154*h* may also include a pair of upper faces 154*g*, 154*h* positioned on a top side of the horizontal joint 122*d* and joined together along an upper portion of the vertical joint 124*d*. The faces 154*e*-154*h* may also include a pair of front-side faces 154*e*, 154*g* positioned on a front side of the vertical joint 124*d* and joined together along a front portion of the horizontal joint 122*d*. The faces 154*e*-154*h* may also include a pair of rear-side faces 154*f*, 154*h* positioned on a rear side of the vertical joint 124*d* and joined together along a rear portion of the horizontal joint 122*d*.

Referring still to FIG. 23, each segment 126*d* of the collapsible body 102*d* includes a lower front surface 132*c* and an opposing upper front surface 132*d* attached along a front hinge 130*c*. Conversely, each segment 126*d* of the collapsible body 102*d* includes a lower rear surface 132*e* and an upper rear surface 132*f* attached to each other along a rear hinge 130*d*. Thus, the front surfaces 132*c*, 132*d* of each segment 126*d* are disposed on an opposite side from the rear surfaces 123*e*, 132*f*, whereby a distance from the front surfaces 132*c*, 132*d* to the rear surfaces 132*e*, 132*f* defines the thickness $T_{102d}$ of the collapsible body 102*d*. In the illustrated example, the lower surfaces 132*c*, 132*e* of the segment 126*d* are parallel to each other and the upper surfaces 132*d*, 132*f* of the segment 126*d* are parallel to each other, whereby the thickness $T_{102d}$ of the collapsible body 102*d* remains substantially constant along the direction of the longitudinal axis $A_{102d}$. However, the lower surfaces 132*c*, 132*e* and the upper surfaces 132*d*, 132*f* are arranged in an alternating orientations (i.e., lower surfaces angle to the front and upper surfaces angle to the rear) such that the lower surfaces 132*c*, 132*e* and the upper surfaces 132*d*, 132*f* cooperate to define an alternating zig-zag profile along the direction of the longitudinal axis $A_{102d}$ of the collapsible body 102*d*.

In use, the collapsible body 102*d* is moved between an expanded state and a collapsed or compressed state to draw and expel a flow of air into and out of the chamber 114*b* through one or more of the valves 108*a*, 108*b* configured in a similar manner as the valves 108*a*, 108*b* discussed previously. In the collapsed state, the front and rear surfaces 132*c*-132*f* fold onto each other along the respective hinges 130*c*, 130*d* while the side surfaces 154*e*-154*h* collapse inwardly upon each other along the joints 122*d*, 124*d*. Thus, the collapsible body 102*d* is moved to the expanded state to draw air into the collapsible body 102*d* through an intake or draw valve 108*a* and moved to the compressed or collapsed state to expel air through the expulsion valve 108*b*. The valves 108*a*, 108*b* may be integrated into either one or both ends 106*c*, 106*d* of the collapsible body 102*d*.

The following Clauses provide an exemplary configuration for an adjustment system for an article of footwear or apparel described above.

Clause 1. An adjustment system for an article of footwear, the adjustment system comprising a body attached to an outer surface of the article of footwear and including a plurality of segments cooperating to define a chamber, the body movable between an elongated state and a collapsed state and a bladder attached to the article of footwear and defining an interior void in fluid communication with the chamber, the bladder movable from a relaxed state to a constricted state when the body is moved from the collapsed state to the elongated state.

Clause 2. The adjustment system of Clause 1, wherein the plurality of segments nest with one another when the body is in the collapsed state.

Clause 3. The adjustment system of any of the preceding Clauses, wherein the plurality of segments provide the body with an accordion shape.

Clause 4. The adjustment system of any of the preceding Clauses, wherein the body includes a plurality of fold lines separating adjacent segments, the plurality of fold lines causing the plurality of segments to be folded on top of one another when the body is moved from the elongated state to the collapsed state.

Clause 5. The adjustment system of any of the preceding Clauses, wherein a volume of fluid is removed from the interior void of the bladder when the bladder is moved from the relaxed state to the constricted state.

Clause 6. The adjustment system of Clause 5, wherein the volume of fluid is moved from the interior void and into the chamber of the body when the body is moved from the collapsed state to the elongated state.

Clause 7. The adjustment system of any of the preceding Clauses, wherein the body is biased into the collapsed state.

Clause 8. The adjustment system of Clause 7, further comprising an elastic member surrounding at least a portion of the body and configured to bias the body into the collapsed state.

Clause 9. The adjustment system of any of the preceding Clauses, wherein segments of the plurality of segments each includes a series of substantially planar surfaces defining a shape of each segment, the substantially planar surfaces being substantially parallel to one another when the body is in the collapsed state.

Clause 10. An article of footwear incorporating the adjustment system of any of the preceding Clauses.

Clause 11. An article of footwear comprising an upper; a body attached to the upper and including a plurality of substantially planar surfaces cooperating to define a chamber, the body movable between an elongated state and a collapsed state and a bladder attached to the upper and defining an interior void in fluid communication with the chamber, the bladder movable from a relaxed state to a constricted state when the body is moved from the collapsed state to the elongated state.

Clause 12. The article of footwear of Clause 11, wherein the plurality of substantially planar surfaces cooperate to provide the body with a plurality of segments each containing at least two substantially planar surfaces of the plurality of substantially planar surfaces.

Clause 13. The article of footwear of Clause 12, wherein the plurality of segments nest with one another when the body is in the collapsed state.

Clause 14. The article of footwear of any of the preceding Clauses, wherein the plurality of substantially planar surfaces provide the body with an accordion shape.

Clause 15. The article of footwear of any of the preceding Clauses, wherein the body includes a plurality of fold lines separating adjacent substantially planar surfaces, the plurality of fold lines causing the plurality of substantially planar surfaces to be folded on top of one another when the body is moved from the elongated state to the collapsed state.

Clause 16. The article of footwear of any of the preceding Clauses, wherein a volume of fluid is removed from the interior void of the bladder when the bladder is moved from the relaxed state to the constricted state.

Clause 17. The article of footwear of Clause 16, wherein the volume of fluid is moved from the interior void and into the chamber of the body when the body is moved from the collapsed state to the elongated state.

Clause 18. The article of footwear of any of the preceding Clauses, wherein the body is biased into the collapsed state.

Clause 19. The article of footwear of Clause 18, further comprising an elastic member surrounding at least a portion of the body and configured to bias the body into the collapsed state.

Clause 20. The article of footwear of any of the preceding Clauses, wherein the plurality of substantially planar surfaces are stacked on one another when the body is moved from the elongated state to the collapsed state.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An adjustment system for an article of footwear, the adjustment system comprising:

a body attached to an outer surface of the article of footwear and including a plurality of segments cooperating to define a chamber, the plurality of segments defined by complex folds defined along a length and width of the body, the complex folds including a compression fold that is defined at least in part by a longitudinal crease, the body movable between an elongated state and a collapsed state; and a bladder attached to the article of footwear and defining an interior void in fluid communication with the chamber, the bladder movable from a relaxed state to a constricted state when the body is moved from the collapsed state to the elongated state.

2. The adjustment system of claim 1, wherein the plurality of segments nest with one another when the body is in the collapsed state.

3. The adjustment system of claim 1, wherein the plurality of segments provide the body with an accordion shape.

4. The adjustment system of claim 1, wherein the body includes a plurality of fold lines separating adjacent segments, the plurality of fold lines causing the plurality of segments to be folded on top of one another when the body is moved from the elongated state to the collapsed state.

5. The adjustment system of claim 1, wherein a volume of fluid is removed from the interior void of the bladder when the bladder is moved from the relaxed state to the constricted state.

6. The adjustment system of claim 5, wherein the volume of fluid is moved from the interior void and into the chamber of the body when the body is moved from the collapsed state to the elongated state.

7. The adjustment system of claim 1, wherein the body is biased into the collapsed state.

8. The adjustment system of claim 7, further comprising an elastic member surrounding at least a portion of the body and configured to bias the body into the collapsed state.

9. The adjustment system of claim 1, wherein segments of the plurality of segments each include a series of substantially planar surfaces defining a shape of each segment, the substantially planar surfaces being substantially parallel to one another when the body is in the collapsed state.

10. An article of footwear incorporating the adjustment system of claim 1.

11. An article of footwear comprising:

an upper;

a body attached to the upper and including a plurality of substantially planar surfaces cooperating to define a chamber, the plurality of substantially planar surfaces defined by complex folds defined along a length and width of the body, the complex folds including a compression fold that is defined at least in part by a longitudinal crease, the body movable between an elongated state and a collapsed state; and a bladder attached to the upper and defining an interior void in fluid communication with the chamber, the bladder movable from a relaxed state to a constricted state when the body is moved from the collapsed state to the elongated state.

12. The article of footwear of claim 11, wherein the plurality of substantially planar surfaces cooperate to provide the body with a plurality of segments each containing at least two substantially planar surfaces of the plurality of substantially planar surfaces.

13. The article of footwear of claim 12, wherein the plurality of segments nest with one another when the body is in the collapsed state.

14. The article of footwear of claim 11, wherein the plurality of substantially planar surfaces provide the body with an accordion shape.

15. The article of footwear of claim 11, wherein the body includes a plurality of fold lines separating adjacent substantially planar surfaces, the plurality of fold lines causing the plurality of substantially planar surfaces to be folded on top of one another when the body is moved from the elongated state to the collapsed state.

16. The article of footwear of claim 11, wherein a volume of fluid is removed from the interior void of the bladder when the bladder is moved from the relaxed state to the constricted state.

17. The article of footwear of claim 16, wherein the volume of fluid is moved from the interior void and into the chamber of the body when the body is moved from the collapsed state to the elongated state.

18. The article of footwear of claim 11, wherein the body is biased into the collapsed state.

19. The article of footwear of claim 18, further comprising an elastic member surrounding at least a portion of the body and configured to bias the body into the collapsed state.

20. The article of footwear of claim 11, wherein the plurality of substantially planar surfaces are stacked on one another when the body is moved from the elongated state to the collapsed state.

* * * * *